US008336708B2

(12) United States Patent
Potterfield et al.

(10) Patent No.: US 8,336,708 B2
(45) Date of Patent: Dec. 25, 2012

(54) SYSTEM AND CONTAINER FOR ORGANIZING AND CARRYING TOOLS AND TOOL SETS

(75) Inventors: Russell A. Potterfield, Columbia, MO (US); Dennis Cauley, Boonville, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 12/177,032

(22) Filed: Jul. 21, 2008

(65) Prior Publication Data

US 2009/0020447 A1 Jan. 22, 2009

Related U.S. Application Data

(60) Provisional application No. 60/951,086, filed on Jul. 20, 2007.

(51) Int. Cl.
*B65D 85/28* (2006.01)

(52) U.S. Cl. ..... 206/373; 206/459.5

(58) Field of Classification Search ..... 206/372, 206/373, 459.5, 576, 234, 317, 374, 375, 206/376, 377, 378, 379
See application file for complete search history.

(56) References Cited

U.S. PATENT DOCUMENTS

| | | | |
|---|---|---|---|
| 197,397 | A | 11/1877 | O'Neil |
| 387,411 | A | 8/1888 | Gisel |
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |
| 1,088,362 | A | 2/1914 | Perkins |
| 1,089,307 | A | 3/1914 | Benet et al. |
| 1,121,945 | A | 12/1914 | Smith |

(Continued)

FOREIGN PATENT DOCUMENTS

| | | |
|---|---|---|
| DE | 838872 | 5/1952 |

(Continued)

OTHER PUBLICATIONS

U.S. Appl. No. 12/276,223, filed Nov. 21, 2008, Potterfield et al.

(Continued)

*Primary Examiner* — Jacob K Ackun
(74) *Attorney, Agent, or Firm* — Perkins Coie LLP

(57) ABSTRACT

Systems and containers for organizing and carrying tools and tool sets are disclosed herein. One aspect of the invention is directed to systems and containers for efficiently organizing tools for specific work tasks, such as gunsmith tools, etc. In one embodiment, a container for carrying and organizing tools includes a housing having a base portion and a lid portion. The lid portion can be pivotally attached to the base portion. The container can also include a plurality of recesses disposed in an internal portion of the container in a recess pattern. The recesses can be configured to releasably retain the tools in the housing. The container also includes an insertable tool position guide having a plurality of images in an image pattern, wherein the image pattern can correspond to the recess pattern. In addition to tool positional information, the tool position guide can also communicate tool identification information.

38 Claims, 11 Drawing Sheets

U.S. PATENT DOCUMENTS

| | | | | | |
|---|---|---|---|---|---|
| 1,145,585 | A | | 7/1915 | Hebard | |
| 1,175,692 | A | | 3/1916 | Boicourt | |
| 1,187,325 | A | | 6/1916 | Ivey | |
| 1,195,777 | A | | 8/1916 | Burtin | |
| 1,250,215 | A | | 12/1917 | Panos | |
| 1,256,255 | A | | 2/1918 | Porter | |
| 1,295,688 | A | | 2/1919 | Butler | |
| 1,367,353 | A | | 2/1921 | Craig | |
| 1,488,647 | A | | 4/1924 | Quinn | |
| 1,491,604 | A | | 4/1924 | Fuller | |
| 1,639,722 | A | | 8/1927 | Whitney | |
| 1,693,289 | A | | 11/1928 | Warren | |
| 1,736,244 | A | | 11/1929 | Baker | |
| 1,902,040 | A | | 3/1933 | Meyer | |
| 1,907,181 | A | | 5/1933 | Fey | |
| 1,927,876 | A | | 9/1933 | Meyer | |
| 1,928,871 | A | | 10/1933 | Swebilius | |
| 2,066,218 | A | | 12/1936 | Morgan | |
| 2,079,510 | A | | 5/1937 | King et al. | |
| 2,090,930 | A | | 8/1937 | Chubb | |
| 2,100,514 | A | | 11/1937 | Miller | |
| 2,121,982 | A | | 6/1938 | Pugsley | |
| 2,125,353 | A | | 8/1938 | Mattson | |
| 2,216,766 | A | | 10/1940 | Cook | |
| 2,232,743 | A | | 2/1941 | Swenson | |
| 2,297,993 | A | | 10/1942 | Tratsch | |
| 2,331,372 | A | | 10/1943 | Buchanan | |
| 2,378,545 | A | | 6/1945 | Fraser et al. | |
| D147,305 | S | | 8/1947 | Sloan | |
| 2,432,519 | A | | 12/1947 | Garand | |
| 2,451,266 | A | | 10/1948 | Whittemore | |
| 2,455,644 | A | | 12/1948 | Barnes | |
| 2,476,078 | A | | 7/1949 | Banks | |
| 2,479,354 | A | | 8/1949 | Hanson | |
| 2,483,089 | A | | 9/1949 | Ferguson | |
| 2,484,801 | A | | 10/1949 | Anderson | |
| 2,508,951 | A | | 5/1950 | Kazimier | |
| 2,510,380 | A | | 6/1950 | Clifford | |
| 2,517,268 | A | | 8/1950 | Wilson | |
| 2,638,676 | A | | 5/1953 | Callahan | |
| 2,677,207 | A | | 5/1954 | Stewart | |
| 2,701,930 | A | | 2/1955 | Dolan | |
| 2,731,829 | A | | 1/1956 | Wigington et al. | |
| 2,740,530 | A | | 4/1956 | Ponder | |
| 2,753,642 | A | | 7/1956 | Sullivan | |
| 2,774,090 | A | | 12/1956 | Allinson | |
| 2,774,563 | A | | 12/1956 | Pribis | |
| 2,795,881 | A | | 6/1957 | Bellows | |
| 2,813,376 | A | | 11/1957 | Middlemark | |
| 2,817,233 | A | | 12/1957 | Dower et al. | |
| 2,821,117 | A | | 1/1958 | Hultgren | |
| 2,847,909 | A | | 8/1958 | Kester | |
| 2,867,931 | A | | 1/1959 | Schreiber | |
| 2,874,707 | A | * | 2/1959 | Koppel | 132/315 |
| 2,877,689 | A | | 3/1959 | Pribis | |
| 2,894,347 | A | | 7/1959 | Woodcock | |
| 2,924,881 | A | | 2/1960 | Gee | |
| 2,924,904 | A | | 2/1960 | Amsler | |
| 2,924,914 | A | | 2/1960 | Garwood | |
| 2,975,540 | A | | 3/1961 | Lewis | |
| 2,999,788 | A | | 9/1961 | Morgan | |
| 3,011,283 | A | | 12/1961 | Lunn et al. | |
| 3,012,350 | A | | 12/1961 | Wold | |
| 3,013,289 | A | | 12/1961 | Sasena | |
| 3,023,527 | A | | 3/1962 | Leek et al. | |
| 3,024,653 | A | | 3/1962 | Broadway | |
| 3,041,938 | A | | 7/1962 | Seabrook | |
| 3,055,655 | A | | 9/1962 | Chelf | |
| 3,060,612 | A | | 10/1962 | Brown et al. | |
| 3,107,642 | A | | 10/1963 | Lakin | |
| 3,112,567 | A | | 12/1963 | Flanagan | |
| 3,125,929 | A | | 3/1964 | Peasley | |
| 3,128,668 | A | | 4/1964 | Dicken | |
| 3,137,957 | A | | 6/1964 | Ingalls | |
| 3,163,420 | A | | 12/1964 | Braun | |
| 3,175,456 | A | | 3/1965 | Goodsell | |
| 3,183,617 | A | | 5/1965 | Ruger et al. | |
| 3,205,518 | A | | 9/1965 | Romaine | |
| 3,206,885 | A | | 9/1965 | Dye | |
| 3,225,656 | A | | 12/1965 | Flaherty et al. | |
| D203,680 | S | | 2/1966 | Allison | |
| 3,240,103 | A | | 3/1966 | Lamont | |
| 3,259,986 | A | | 7/1966 | Carr | |
| 3,283,425 | A | | 11/1966 | Boyd | |
| 3,283,643 | A | | 11/1966 | Mittelsteadt | |
| 3,291,317 | A | | 12/1966 | Bowen | |
| 3,292,293 | A | | 12/1966 | Chiasera et al. | |
| 3,320,848 | A | | 5/1967 | Ponsness | |
| 3,323,246 | A | | 6/1967 | Loffler | |
| 3,327,422 | A | | 6/1967 | Harris | |
| 3,330,561 | A | | 7/1967 | Kandel | |
| 3,343,411 | A | | 9/1967 | Lee | |
| 3,353,827 | A | | 11/1967 | Dun, Jr. | |
| 3,370,852 | A | | 2/1968 | Kandel | |
| 3,406,969 | A | | 10/1968 | Tisdell et al. | |
| 3,423,092 | A | | 1/1969 | Kandel | |
| D215,311 | S | | 9/1969 | Born | |
| 3,486,752 | A | | 12/1969 | Colvin | |
| 3,499,525 | A | | 3/1970 | Kanter | |
| 3,510,951 | A | | 5/1970 | Dow | |
| 3,513,604 | A | | 5/1970 | Matsunaga et al. | |
| 3,536,160 | A | | 10/1970 | Brewer | |
| 3,550,941 | A | | 12/1970 | Spiro et al. | |
| 3,556,666 | A | | 1/1971 | Lichenstern | |
| D220,154 | S | | 3/1971 | Irelan | |
| 3,572,712 | A | | 3/1971 | Vick | |
| 3,580,127 | A | | 5/1971 | Lee | |
| 3,583,556 | A | | 6/1971 | Wagner | |
| 3,584,820 | A | | 6/1971 | Butcher, Sr. | |
| 3,587,193 | A | | 6/1971 | Lewis | |
| 3,608,225 | A | | 9/1971 | Manuel | |
| 3,646,704 | A | | 3/1972 | Ellsworth | |
| 3,648,909 | A | | 3/1972 | Wisecarver | |
| 3,680,266 | A | | 8/1972 | Shiplov | |
| 3,680,354 | A | | 8/1972 | Phillips, Jr. | |
| 3,711,955 | A | | 1/1973 | Holt | |
| 3,711,984 | A | | 1/1973 | Dyer et al. | |
| 3,736,243 | A | | 5/1973 | Duggan | |
| 3,738,101 | A | | 6/1973 | Simon-Vermot | |
| 3,739,515 | A | | 6/1973 | Koon, Jr. | |
| 3,743,088 | A | * | 7/1973 | Henkin | 206/569 |
| 3,744,292 | A | | 7/1973 | Michelson | |
| 3,745,875 | A | | 7/1973 | Kennedy et al. | |
| 3,748,950 | A | | 7/1973 | Huntington | |
| 3,764,219 | A | | 10/1973 | Collins | |
| 3,769,758 | A | | 11/1973 | McDonald | |
| 3,771,176 | A | | 11/1973 | Herman, Sr. | |
| 3,804,238 | A | * | 4/1974 | Howard | 206/459.5 |
| 3,813,816 | A | | 6/1974 | Funk | |
| 3,815,270 | A | | 6/1974 | Pachmayr | |
| 3,826,559 | A | | 7/1974 | Berliner et al. | |
| 3,827,172 | A | | 8/1974 | Howe | |
| 3,842,527 | A | | 10/1974 | Low | |
| D233,853 | S | | 12/1974 | Ferrara | |
| 3,877,178 | A | | 4/1975 | Campanelli | |
| 3,878,939 | A | * | 4/1975 | Wilcox | 206/373 |
| 3,885,357 | A | | 5/1975 | Hoyt | |
| 3,893,266 | A | | 7/1975 | Anderson et al. | |
| 3,895,803 | A | | 7/1975 | Loe | |
| 3,899,175 | A | | 8/1975 | Loe | |
| 3,899,797 | A | | 8/1975 | Gunst | |
| D237,106 | S | | 10/1975 | Baljet et al. | |
| 3,913,746 | A | | 10/1975 | Burton | |
| 3,914,879 | A | | 10/1975 | Taylor, III et al. | |
| 3,935,657 | A | | 2/1976 | Wade | |
| 3,947,988 | A | | 4/1976 | Besaw | |
| 3,949,987 | A | | 4/1976 | Candor | |
| 3,961,436 | A | | 6/1976 | Hagen et al. | |
| 3,964,613 | A | | 6/1976 | Anderson, Jr. | |
| 3,979,849 | A | | 9/1976 | Haskins | |
| 4,007,554 | A | | 2/1977 | Helmstadter | |
| 4,012,860 | A | | 3/1977 | Auger | |
| 4,021,971 | A | | 5/1977 | McFadden | |
| 4,026,057 | A | | 5/1977 | Cady | |
| 4,027,781 | A | | 6/1977 | Covert | |
| 4,042,242 | A | | 8/1977 | Nicholls et al. | |
| 4,054,288 | A | | 10/1977 | Perrine, Sr. | |

4,055,016 A 10/1977 Katsenes
4,072,313 A 2/1978 Murso et al.
4,076,247 A 2/1978 Kim et al.
4,090,606 A * 5/1978 Dawson ..... 206/223
4,120,108 A 10/1978 Vickers et al.
4,120,276 A 10/1978 Curran
4,122,623 A 10/1978 Stice
4,143,491 A 3/1979 Blanc
4,177,608 A 12/1979 Balz
4,188,855 A 2/1980 Alberts
4,203,600 A 5/1980 Brown
4,206,573 A 6/1980 Hayward
4,222,305 A 9/1980 Lee
4,223,588 A 9/1980 Simpson
4,233,748 A 11/1980 Ford et al.
D257,687 S 12/1980 Bechtel
4,266,748 A 5/1981 Dalton
4,266,780 A 5/1981 McQuary
4,282,671 A 8/1981 Wood et al.
D260,650 S 9/1981 Alviti
D261,794 S 11/1981 Bechtel
4,301,625 A 11/1981 Rampe
4,312,146 A 1/1982 Koon, Jr.
4,332,185 A 6/1982 Hargrove
4,333,385 A 6/1982 Culver
4,338,726 A 7/1982 Swailes
4,340,370 A 7/1982 Marshall et al.
4,345,398 A 8/1982 Pickett
4,346,530 A 8/1982 Stewart et al.
4,359,833 A 11/1982 Pachmayr et al.
4,361,989 A 12/1982 Ohno
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,438,913 A 3/1984 Hylla
4,449,314 A 5/1984 Sorensen
4,462,598 A 7/1984 Chalin et al.
4,477,082 A 10/1984 McKenzie et al.
4,480,411 A 11/1984 Balz et al.
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,542,677 A 9/1985 Lee
4,548,392 A 10/1985 Rickling
4,558,531 A 12/1985 Kilby
D283,561 S 4/1986 Geist et al.
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 DeVaul et al.
4,715,499 A * 12/1987 Franklin ..... 206/373
4,716,673 A 1/1988 Williams et al.
4,721,205 A 1/1988 Burt et al.
4,723,472 A 2/1988 Lee
4,729,186 A 3/1988 Rieger et al.
4,736,843 A * 4/1988 Leonard ..... 206/369
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A 1/1989 Nodo
4,807,381 A 2/1989 Southard
4,815,593 A 3/1989 Brown
4,819,359 A 4/1989 Bassett
4,821,422 A 4/1989 Porter
4,821,443 A 4/1989 Bianco et al.
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,890,406 A 1/1990 French
4,890,847 A 1/1990 Cartee et al.
4,896,446 A 1/1990 Gregory
D306,234 S 2/1990 Ferstl et al.
4,903,425 A 2/1990 Harris
4,910,904 A 3/1990 Rose
4,918,825 A 4/1990 Lesh et al.
4,921,256 A 5/1990 Gearhart
4,923,402 A 5/1990 Marshall et al.
4,924,616 A 5/1990 Bell et al.
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,070,636 A 12/1991 Mueller
5,074,188 A 12/1991 Harris
5,081,783 A 1/1992 Jarvis
5,117,850 A 6/1992 Money
5,123,194 A 6/1992 Mason
5,125,389 A 6/1992 Paff
5,143,340 A 9/1992 Wood et al.
5,149,900 A 9/1992 Buck
5,173,563 A 12/1992 Gray
5,180,874 A 1/1993 Troncoso, Jr.
5,185,927 A 2/1993 Rivers
5,186,468 A 2/1993 Davies
5,188,371 A 2/1993 Edwards
5,194,678 A 3/1993 Kramer
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,233,779 A 8/1993 Shaw
5,235,764 A 8/1993 Perazzi et al.
5,237,778 A 8/1993 Baer
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,317,826 A 6/1994 Underwood
5,320,217 A 6/1994 Lenarz
5,320,223 A * 6/1994 Allen ..... 206/372
5,328,029 A 7/1994 Chow et al.
5,332,185 A 7/1994 Walker, III
5,333,829 A 8/1994 Bell et al.
5,335,578 A 8/1994 Lorden et al.
5,337,505 A 8/1994 Brown et al.
5,344,012 A * 9/1994 Matthews ..... 206/372
5,347,740 A 9/1994 Rather et al.
5,351,428 A 10/1994 Graham
5,358,254 A 10/1994 Yeh et al.

5,361,505 A 11/1994 Faughn
5,367,232 A 11/1994 Netherton et al.
5,370,240 A 12/1994 Hand
5,375,337 A 12/1994 Butler
5,375,377 A 12/1994 Kenton
5,377,437 A 1/1995 Underwood
5,392,553 A 2/1995 Carey
5,394,983 A * 3/1995 Latulippe et al. ..... 206/370
5,402,595 A 4/1995 Tamllos
5,406,733 A 4/1995 Tarlton et al.
5,410,833 A 5/1995 Paterson
5,414,949 A 5/1995 Peebles
D359,392 S 6/1995 Bellington
5,421,115 A 6/1995 McKay
5,433,010 A 7/1995 Bell
5,435,223 A 7/1995 Blodgett et al.
5,442,860 A 8/1995 Palmer
D362,116 S 9/1995 Bellington et al.
5,446,987 A 9/1995 Lee et al.
D364,080 S 11/1995 Weyrauch
5,481,817 A 1/1996 Parker
5,482,241 A 1/1996 Oglesby
5,486,135 A 1/1996 Arpaio
5,490,302 A 2/1996 Dion
5,491,921 A 2/1996 Allen
5,497,557 A 3/1996 Martinsson et al.
5,497,575 A 3/1996 Fried et al.
5,501,467 A 3/1996 Kandel
D369,904 S 5/1996 Taylor
5,525,314 A * 6/1996 Hurson ..... 422/300
5,540,329 A * 7/1996 Vogeley ..... 206/373
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,588,242 A 12/1996 Hughes
5,600,913 A 2/1997 Minneman
5,617,666 A 4/1997 Scott
5,622,344 A 4/1997 Gracie
5,628,135 A 5/1997 Cady
5,640,944 A 6/1997 Minneman
5,644,862 A 7/1997 Folmer
5,649,465 A 7/1997 Beebe
5,651,207 A 7/1997 Knight
5,653,625 A 8/1997 Pierce et al.
5,661,919 A 9/1997 Pryor
5,662,516 A 9/1997 You
5,666,757 A 9/1997 Helmstadter
D387,123 S 12/1997 Hughes et al.
5,703,317 A 12/1997 Levilly et al.
5,704,482 A 1/1998 Apps et al.
5,711,102 A 1/1998 Plaster et al.
5,711,103 A 1/1998 Keng
5,715,625 A 2/1998 West, III
D391,616 S 3/1998 Plybon
5,723,183 A 3/1998 Williams et al.
5,723,806 A 3/1998 Odom
5,725,096 A * 3/1998 Winnard ..... 206/350
5,737,865 A 4/1998 Brandl et al.
5,740,625 A 4/1998 Jenkins
5,743,395 A * 4/1998 Backer ..... 206/378
5,758,447 A 6/1998 Venetz
5,758,933 A 6/1998 Clendening
5,761,954 A 6/1998 Dvorak
5,778,589 A 7/1998 Teague
5,779,527 A 7/1998 Maebashi
5,811,720 A 9/1998 Quinnell et al.
5,813,131 A 9/1998 Werre
5,815,974 A 10/1998 Keng
5,833,308 A 11/1998 Strong, III et al.
D403,176 S 12/1998 Harper
5,845,774 A * 12/1998 Hausknecht ..... 206/379
5,857,279 A 1/1999 de Oliveira Masina et al.
5,875,580 A 3/1999 Hill et al.
5,878,504 A 3/1999 Harms
5,884,966 A 3/1999 Hill et al.
5,899,329 A 5/1999 Hu et al.
5,907,919 A 6/1999 Keeney
5,913,422 A * 6/1999 Cote et al. ..... 206/370
5,913,667 A 6/1999 Smilee
5,913,668 A 6/1999 Messer
5,924,694 A 7/1999 Kent
5,930,932 A 8/1999 Peterson
5,933,997 A 8/1999 Barrett
5,933,999 A 8/1999 McClure et al.
5,959,613 A 9/1999 Rosenberg et al.
5,970,642 A 10/1999 Martin
5,974,719 A 11/1999 Simonek
6,019,375 A 2/2000 West, Jr.
6,021,891 A 2/2000 Anderson
6,032,796 A * 3/2000 Hopper et al. ..... 206/377
6,044,747 A 4/2000 Felts
6,058,641 A 5/2000 Vecqueray
6,073,381 A 6/2000 Farrar et al.
6,086,375 A 7/2000 Legros
6,092,662 A * 7/2000 Frederick, Jr. ..... 206/582
6,110,020 A 8/2000 Rolfi
6,121,556 A 9/2000 Cole
6,237,462 B1 5/2001 Hawkes et al.
6,254,100 B1 7/2001 Rinehart
6,260,463 B1 7/2001 Brand et al.
6,283,428 B1 9/2001 Maples et al.
6,289,622 B1 9/2001 Desch, Jr. et al.
6,293,041 B2 9/2001 Weaver
6,294,759 B1 9/2001 Dunn, Jr.
6,305,117 B1 10/2001 Hales, Sr.
6,309,476 B1 10/2001 Ravenscroft et al.
6,338,218 B1 1/2002 Hegler
6,390,294 B1 5/2002 Fiore, Jr. et al.
6,397,720 B1 6/2002 Fox et al.
6,439,515 B1 8/2002 Powers
6,439,530 B1 8/2002 Schoenfish et al.
6,517,133 B2 2/2003 Seegmiller et al.
D471,248 S 3/2003 Jacobs
6,526,687 B1 3/2003 Looney
D473,376 S 4/2003 Abate
6,546,662 B1 4/2003 Chong
6,574,899 B1 6/2003 Mostello
6,575,469 B2 6/2003 Love
6,643,973 B1 11/2003 Smith
6,663,298 B2 12/2003 Haney
6,688,031 B2 2/2004 Steele
6,733,375 B2 5/2004 Hoffman
6,736,400 B1 5/2004 Cesternino
6,813,855 B2 11/2004 Pinkley
6,814,654 B2 11/2004 Rolfi
6,854,975 B2 2/2005 Ranzinger
6,860,054 B1 3/2005 Mosher
6,862,833 B1 3/2005 Gurtner
6,871,440 B2 3/2005 Highfill et al.
6,877,266 B1 4/2005 Brownlee
6,883,263 B1 4/2005 Carrow
6,931,777 B1 8/2005 Krien
6,953,114 B2 10/2005 Wang et al.
D513,055 S 12/2005 Lahti
6,978,569 B2 12/2005 Williamson, IV et al.
D519,183 S 4/2006 Minneman
7,032,494 B2 4/2006 Wygant
D521,100 S 5/2006 Morrow
7,062,979 B2 6/2006 Day et al.
D524,541 S 7/2006 Cauley
7,086,192 B2 8/2006 Deros
7,104,398 B1 9/2006 Wisecarver
7,134,663 B1 11/2006 Lowe et al.
7,143,986 B1 12/2006 Austin et al.
7,152,355 B2 12/2006 Fitzpatrick et al.
7,152,358 B1 12/2006 LeAnna et al.
7,159,711 B1 1/2007 Gardner
D540,904 S 4/2007 Werner
7,207,567 B1 4/2007 Brown
7,213,494 B2 5/2007 James
7,225,050 B2 5/2007 Sutula, Jr.
D553,219 S 10/2007 Potterfield
7,281,346 B1 10/2007 Cook et al.
D567,895 S 4/2008 Cauley
7,356,961 B2 4/2008 Williams
7,357,250 B2 4/2008 Hagemann et al.

| | | | | |
|---|---|---|---|---|
| 7,363,740 | B2 | 4/2008 | Kincel | |
| 7,367,451 | B2 * | 5/2008 | Pendergraph et al. | 206/379 |
| 7,401,431 | B2 | 7/2008 | Pierce et al. | |
| 7,410,053 | B2 * | 8/2008 | Bowen et al. | 206/373 |
| D576,245 | S | 9/2008 | Potterfield et al. | |
| 7,421,815 | B1 | 9/2008 | Moody et al. | |
| 7,426,800 | B2 | 9/2008 | Pierce et al. | |
| 7,584,690 | B2 | 9/2009 | Cauley | |
| D605,246 | S | 12/2009 | Hobbs | |
| 7,631,455 | B2 | 12/2009 | Keng et al. | |
| 7,676,977 | B1 | 3/2010 | Cahill et al. | |
| 7,726,478 | B2 | 6/2010 | Potterfield et al. | |
| 7,730,824 | B1 | 6/2010 | Black | |
| 2002/0113372 | A1 | 8/2002 | Love | |
| 2002/0195752 | A1 | 12/2002 | Yang | |
| 2003/0079395 | A1 | 5/2003 | Chong | |
| 2003/0234205 | A1 * | 12/2003 | McGuyer et al. | 206/564 |
| 2004/0020097 | A1 | 2/2004 | Deros | |
| 2004/0112777 | A1 * | 6/2004 | Huang | 206/349 |
| 2004/0134113 | A1 | 7/2004 | Deros et al. | |
| 2005/0000141 | A1 | 1/2005 | Cauley et al. | |
| 2005/0011101 | A1 | 1/2005 | Gooder | |
| 2005/0115137 | A1 | 6/2005 | Minneman | |
| 2005/0178039 | A1 | 8/2005 | Flores | |
| 2005/0183319 | A1 | 8/2005 | Franks | |
| 2005/0188597 | A1 | 9/2005 | Keng et al. | |
| 2005/0242250 | A1 | 11/2005 | Keng et al. | |
| 2006/0070900 | A1 * | 4/2006 | Brunson et al. | 206/373 |
| 2006/0174532 | A1 | 8/2006 | Popikow | |
| 2006/0175213 | A1 | 8/2006 | Hurt et al. | |
| 2006/0218840 | A1 | 10/2006 | Cauley | |
| 2006/0236584 | A1 | 10/2006 | Williams | |
| 2006/0248774 | A1 | 11/2006 | Pierce et al. | |
| 2006/0248775 | A1 | 11/2006 | Wade et al. | |
| 2006/0254111 | A1 | 11/2006 | Giauque et al. | |
| 2006/0277811 | A1 | 12/2006 | Peterson | |
| 2006/0278797 | A1 | 12/2006 | Keng et al. | |
| 2007/0029733 | A1 | 2/2007 | Anderson | |
| 2007/0046760 | A1 | 3/2007 | Zara | |
| 2007/0051028 | A1 | 3/2007 | Stordal | |
| 2007/0068379 | A1 | 3/2007 | Sween et al. | |
| 2007/0068835 | A1 | 3/2007 | Buie | |
| 2007/0074439 | A2 | 4/2007 | Cauley et al. | |
| 2007/0074440 | A2 | 4/2007 | Cauley | |
| 2007/0094911 | A1 | 5/2007 | Rush et al. | |
| 2007/0113460 | A1 | 5/2007 | Potterfield et al. | |
| 2007/0175077 | A1 | 8/2007 | Laney et al. | |
| 2007/0256346 | A1 | 11/2007 | Potterfield et al. | |
| 2007/0262529 | A1 | 11/2007 | Gamez et al. | |
| 2007/0266610 | A1 | 11/2007 | Coffield | |
| 2007/0294929 | A1 | 12/2007 | Potterfield et al. | |
| 2007/0294930 | A1 | 12/2007 | Mays | |
| 2007/0295197 | A1 | 12/2007 | Potterfield | |
| 2008/0023379 | A1 | 1/2008 | Potterfield et al. | |
| 2008/0023915 | A1 | 1/2008 | Morrow et al. | |
| 2008/0034636 | A1 | 2/2008 | Potterfield et al. | |
| 2008/0041700 | A1 | 2/2008 | Potterfield et al. | |
| 2008/0047189 | A1 | 2/2008 | Potterfield et al. | |
| 2008/0054570 | A1 | 3/2008 | Potterfield et al. | |
| 2008/0061509 | A1 | 3/2008 | Potterfield | |
| 2008/0127815 | A1 | 6/2008 | Yale et al. | |
| 2008/0128002 | A1 | 6/2008 | Jeffs | |
| 2008/0156671 | A1 * | 7/2008 | Jansson | 206/216 |
| 2008/0163534 | A1 | 7/2008 | Lombardi | |
| 2008/0168697 | A1 | 7/2008 | Potterfield et al. | |
| 2008/0174071 | A1 | 7/2008 | Potterfield et al. | |
| 2009/0049731 | A1 | 2/2009 | Seuk | |
| 2009/0056192 | A1 | 3/2009 | Oz | |
| 2009/0126250 | A1 | 5/2009 | Keng | |
| 2010/0116163 | A1 | 5/2010 | Zara | |
| 2010/0138032 | A1 | 6/2010 | Potterfield | |
| 2011/0024985 | A1 | 2/2011 | Potterfield et al. | |
| 2011/0036236 | A1 | 2/2011 | Potterfield et al. | |
| 2011/0079524 | A1 | 4/2011 | Potterfield et al. | |
| 2011/0225788 | A1 | 9/2011 | Potterfield et al. | |

FOREIGN PATENT DOCUMENTS

| | | |
|---|---|---|
| EP | 0624455 | 11/1994 |
| GB | 475080 | 11/1937 |

OTHER PUBLICATIONS

U.S. Appl. No. 12/276,229, filed Nov. 21, 2008, Cauley et al.
"Cabela's Rotary Media Separator," http://www.cabelas/en/templates/links/link.jsp;jsessionid=QYVQMKM0P0P5.., 2 pages [Internet accessed Apr. 24, 2007].
Brass Cleaning Kits, http://www.berrysmfg.com/81.php, 1 page [Internet accessed Apr. 24, 2007].
Final Office Action; U.S. Appl. No. 11/206,430; Mailed on Nov. 24, 2008, 28 pages.
Final Office Action; U.S. Appl. No. 11/339,863; Mailed on Mar. 10, 2009, 22 pages.
Final Office Action; U.S. Appl. No. 11/505,784; Mailed on Dec. 19, 2008, 10 pages.
Non-Final Office Action; U.S. Appl. No. 11/418,407; Mailed on Feb. 24, 2009, 9 pages.
Non-Final Office Action; U.S. Appl. No. 11/431,956; Mailed on Mar. 2, 2009, 16 pages.
Non-Final Office Action; U.S. Appl. No. 11/607,550; Mailed on Mar. 2, 2009, 11 pages.
Non-Final Office Action; U.S. Appl. No. 11/801,341; Mailed on Jan. 13, 2009, 7 pages.
Non-Final Office Action; U.S. Appl. No. 11/853,763; Mailed on Dec. 22, 2008, 6 pages.
RCBS, "Reloading Equipment," http://www.rcbs.com/default.asp?menu=1&s1=4&s2=3&s3=25, 1 page [Internet accessed Apr. 24, 2007].
The Blue Press, "Dillon Case Preparation Equipment," http://dillonprecision.corn/template/p.cfm?maj=16&min=0&dyn=1&, Apr. 2007, 2 pages [Internet accessed Apr. 24, 2007].
U.S. Appl. No. 12/476,041, filed Jun. 1, 2008, Cauley.
U.S. Appl. No. 12/578,393, filed Oct. 13, 2009, Morrow et al.
Final Office Action; U.S. Appl. No. 11/679,100; Mailed on Aug. 3, 2009, 9 pages.
Final Office Action; U.S. Appl. No. 11/679,136; Mailed on Apr. 10, 2009, 22 pages.
Final Office Action; U.S. Appl. No. 11/801,341; Mailed on Sep. 30, 2009, 6 pages.
Final Office Action; U.S. Appl. No. 11/853,763; Mailed on Jul. 13, 2009, 7 pages.
Non-Final Office Action; U.S. Appl. No. 11/679,169; Mailed on Apr. 28, 2009, 11 pages.
Non-Final Office Action; U.S. Appl. No. 11/679,832; Mailed on Aug. 28, 2009, 9 pages.
Non-Final Office Action; U.S. Appl. No. 11/739,077; Mailed on Oct. 8, 2009, 7 pages.
Non-Final Office Action; U.S. Appl. No. 11/853,745; Mailed on Jun. 19, 2009, 11 pages.
Non-Final Office Action; U.S. Appl. No. 12/117,668; Mailed on Aug. 13, 2009, 15 pages.
Non-Final Office Action; U.S. Appl. No. 12/209,113; Mailed on Sep. 23, 2009, 6 pages.
Non-Final Office Action; U.S. Appl. No. 11/206,430; Mailed on Jun. 23, 2009, 13 pages.
Non-Final Office Action; U.S. Appl. No. 11/505,784; Mailed on Oct. 27, 2009, 8 pages.
U.S. Appl. No. 12/623,238, filed Nov. 20, 2009, Potterfield.
Final Office Action; U.S. Appl. No. 11/206,430; Mailed on Apr. 1, 2010, 14 pages.
Final Office Action; U.S. Appl. No. 11/431,956; Mailed on Nov. 27, 2009, 13 pages.
Final Office Action; U.S. Appl. No. 11/507,683; Mailed on Apr. 6, 2010, 7 pages.
Final Office Action; U.S. Appl. No. 11/607,550; Mailed on Nov. 27, 2009, 14 pages.
Non-Final Office Action; U.S. Appl. No. 11/740,908; Mailed on Jan. 29, 2010, 8 pages.
Non-Final Office Action; U.S. Appl. No. 11/746,551; Mailed on Apr. 14, 2010, 8 pages.
Non-Final Office Action; U.S. Appl. No. 12/476,041; Mailed on Nov. 18, 2009, 6 pages.
Final Office Action; U.S. Appl. No. 12/848,649; Mailed on Jan. 18, 2012, 6 pages.

Non-Final Office Action; U.S. Appl. No. 11/607,550; Mailed on Jun. 17, 2010, 12 pages.
Non-Final Office Action; U.S. Appl. No. 11/679,100; Mailed on May 28, 2010, 9 pages.
Non-Final Office Action; U.S. Appl. No. 12/276,229; Mailed on Aug. 30, 2010, 8 pages.
Non-Final Office Action; U.S. Appl. No. 12/172,848, Mailed on Nov. 22, 2010, 32 pages.
Non-Final Office Action; U.S. Appl. No. 11/206,430; Mailed on Oct. 14, 2010, 18 pages.
Non-Final Office Action; U.S. Appl. No. 12/614,578; Mailed on Dec. 8, 2011, 12 pages.
Non-Final Office Action; U.S. Appl. No. 12/899,418; Mailed on Jan. 3, 2012, 30 pages.
Non-Final Office Action; U.S. Appl. No. 11/746,551; Mailed on Jul. 8, 2011, 14 pages.
Non-Final Office Action; U.S. Appl. No. 12/769,438; Mailed on Jul. 15, 2011, 55 pages.
Non-Final Office Action; U.S. Appl. No. 12/276,223; Mailed on Jul. 19, 2011, 11 pages.
Non-Final Office Action; U.S. Appl. No. 11/607,550; Mailed on Nov. 23, 2011, 8 pages.
U.S. Appl. No. 11/431,956, filed May 10, 2006, Morrow et al.
U.S. Appl. No. 11/505,784, filed Aug. 16, 2006, Cauley.
U.S. Appl. No. 11/679,832, filed Feb. 27, 2007, Cauley et al.
U.S. Appl. No. 11/739,077, filed Apr. 23, 2007, Cauley et al.
U.S. Appl. No. 11/801,341, filed Apr. 23, 2007, Potterfield et al.
U.S. Appl. No. 11/862,821, filed Sep. 27, 2007, Cesternino.
U.S. Appl. No. 11/935,381, filed Nov. 5, 2007, Potterfield.
U.S. Appl. No. 11/937,466, filed Nov. 8, 2007, Potterfield et al.
U.S. Appl. No. 12/037,336, filed Feb. 26, 2008, Potterfield.
U.S. Appl. No. 12/117,668, filed May 8, 2008, Potterfield et al.
U.S. Appl. No. 12/172,848, filed Jul. 14, 2008, Cesternino et al.
"American Rifleman: What to do about recoil," LookSmart, http://www.findarticles.com/p/articles/mi_qa3623/is_199907/ai_n8861959/print, pp. 1-4 [Internet accessed on Jan. 4, 2006].
"Cleaning Cradles: Sinclaire Cleaning Cradles," p. 21, The date on which the Sinclair Folding Cleaning Cradle was first on sale is not known, but is believed to be circa 2004.
"Decker Rifle Vise," 1 page, the date on which the Decker Rifle Vise was first on sale is not known but is believed to be circa 2004.
Amazon.com, "Eforcity Magnetic Screwdriver Set w/15 bits; Great for Cellphones, Computers; Includes: T6, Torx, Security Torx, Philips, Slotted, Spanner, Tri-Wing, Bent Pry Tool, Round Awl, Reset Pin for Game Boy Advance, Nintendo WII, DS Lite, NDS, Apple TV," 1 page [Internet accessed on Sep. 18, 2007].
Battenfeld Technologies, Inc., "Gun Vise," Tipton Gun Cleaning Supplies, Battenfeld Technologies, Inc. 2004 Catalog, p. 32, Product No. 782-731, 2 pgs.
"The Grabber and Hustler '76," MEC—Mayville Engineering Company, Inc., 2 pgs., undated.
1shop2.com "Hoppe's Gunsmith's Fully Adjustable Bench Vise," http://www.1shop2.com/outdoor_sports/Hoppe's—Gunsmith's-Fully-Adj . . . , 3 pgs, the date on which the Hoppe's Gunsmith's Fully Adjustable Bench Vise was first on sale is not known, but is believed to be circa 2004.
AcuSport, Outdoor Sporting Products, 3 pgs., undated.
Battenfeld Technologies, Inc., "Steady Rest Portable Shooting Rest," 1 page [Internet accessed Jan. 25, 2006].
Birchwood Casey 2005 Catalog, 28 pages.
Birchwood Casey 2006 Catalog, pp. 5-17.
Birchwood Casey, "Dirty Bird® Splattering Targets," http://www.birchwoodcasey.com/sport/target_index.asp?categoryID=4&subcat=22, pp. 1-4 [Internet accessed Jan. 16, 2006].
Birchwood Casey, "Shoot•N•C® Targets," http://www.birchwoodcasey.com/sport/target_index.asp?categoryID=4&subcat=8, pp. 1-8 [Internet accessed Jan. 16, 2006].
Birchwood Casey, "Targets Spots®," http://www.birchwoodcasey.com/sport_index.asp?categoryID=4&subcat=12, pp. 1-2 [Internet accessed Jan. 16, 2006].
Birchwood Casey, "World of Targets®," http://www.birchwoodcasey.com/sport/target_index.asp?categoryID=4&subcat=13, pp. 1-4 [Internet accessed Jan. 16, 2006].
Brownells, Inc., "Brownells Magna-Tip Screwdriver," Brownells Catalog No. 54, 2001-2002, p. 151.
Brownells, Inc., "Brownells Magna-Tip Super-Sets," Brownells Catalog No. 54, 2001-2002, p. 153.
Brownells, Inc., Catalog No. 41, 1988-1989, 3 pgs.
Brownells, Inc., Catalog No. 47, 1994-1995, 2 pgs.
Brownells, Inc., Catalog No. 57, 2004-2005. 2 pgs.
Brownells, Inc., Sight Base Cutters, Faxed Dec. 17, 2003, 1 page.
B-Square, Pro Gunsmith Screwdriver Set, B-Square Mounts Tools Accessories Product Catalog, p. 23, date unknown.
Cabela's Master Catalog, Fall 2002, Edition II, p. 416.
Cabela's Master Catalog, Fall 2003, Late-Season Edition, p. 416.
Cabela's, "HySkore Sighting System and Cleaning Vise," The date on which the HySkore Sighting System and Cleaning Vise was first on sale is not known, but is believed to be circa Jan. 2005, however, a prototype of this product may have been shown to buyers at Cabela's circa Aug. 2004, 1 page.
Caldwell Insta-Viewn™ 4 Targets.
Caldwelln™ Shooting Supplies, Targets & Target Accessories, Instra-View™ Targets, 1 page.
Californiavarmintcallers.com—Forum, http://califomiavarmintcallers.com/community/modules/newbb/viewtopic.php?topic_id=10&forum=9&PHPSESSID=074ed8c7 . . . , pp. 1-4 [Internet accessed Jan. 16, 2006].
Champion Target, "Next Generation Paper Targets," http://www.championtarget.com/products/targets/next_generation_targets.aspx, pp. 1-3, [Internet accessed on Jan. 16, 2006].
Champion Traps & Target, 2005 Product Catalog, 12 pgs.
Ellett Brothers, Rests & Gun Vises, pp. 621-622, date unknown.
Lohman Sight Vise, 4 pages product photographs, the date on which the Lohman Site Vise was first on sale is not known, but is believed to be circa 2004.
Milek, B., "Handloading for Hunting" New Products from RCBS, Lee, Accurate Arms, Peterson's Hunting, Mar. 1985, p. 21.
Hyskore: Professional Shooting Accessories, "Dangerous Game Machine Rest," www.hyskore.com, 10 pgs. [Internet accessed Feb. 22, 2006].
Hyskore: Professional Shooting Accessories, "Hydraulic Trigger Release," www.hyskore.com, 7 pgs. [Internet accessed Feb. 22, 2006].
Lahti Company Brochure, "Rock Solid Hold," Rifle Evaluator, http://www.lathicompany.com/Forms/EvaluatorBrochure2.jpg, 2 pgs. [Internet accessed Jan. 16, 2006].
Lahti Company Brochure, "Rifle Evaluator: No Pain, No Fear, No Flinching, No Body Movement," www.lahticompany.com, 2 pgs., Undated.
Lee Precision, Inc., "The World's Fastest Handloading Press . . . Lee Progressive 1000," 1985 Catalog, pp. 1-15.
Lee Precision, Inc., "Load-All," 1 page.
Lyman, "A History of Lyman Metallic Reloading," Reloading Handbook, 46th Edition, pp. 10-31.
Lyman, "Introduction to Reloading," Reloading Handbook, 46th Edition, pp. 170-203.
Carmichael, J., "Reloading for Accuracy," Lyman Reloading Handbook, 46th Edition, pp. 68-77.
Midway USA, "Chapman 27-Piece Deluxe Screwdriver Set," Master Catalog #2 and Reference Guide, 2004, Product # 510-765, p. 440.
Midway USA, "Pachmayr Professional Screwdriver Set," Master Catalog #2 and Reference Guide, 2004, Product #776-936, p. 448.
Midway USA, "Wheeler Engineering Space-Saver Gunsmithing Screwdriver Set," Master Catalog #2 and Reference Guide, 2004, Product #297-593, p. 453.
Midway USA. "Tipton Range Box with Ultimate Rifle, Handgun Cleaning Kit (No Solvents)," http://www.midwayusa.com/rewriteaproduct/135086, The date on which the Tipton Range Box was first on sale is not known, but is believed to be circa 2004, 2 pages.
MTM Case-Gard, "Gun Maintenance Centers," http://www/mtmcase-gard.com/products/shooting/gunm.html, The date on which the MTM Gun Maintenance Center was first on sale is not known, but is believed to be circa 2004, 2 pages [Internet accessed Oct. 11, 2006].

MTM Case-Gard, "Rifle rest and pistol shooting rest," http://www/mtmcase-gard.com/products/shooting/shoo.html, The date on which the MTM Site-In-Clean was first on sale is not known, but is believed to be circa 2004, 3 pages [Internet accessed Oct. 11, 2006].
MTM Case-Gard, "MTM Shoulder-Gard Rifle Rest," Cover Photo for Rest, p. 2.
Caldwells Insta-View 4 Targets, 1 page [product photo].
CV-500, 3 pages [product photos].
Dillon Precision CV-500 Cartridge Case Vibratory Cleaner, 6 pages [product photos].
Lyman Hornady Case Tumbler, 3 pages [product photos].
Lyman Turbo 600 Tumbler, 3 pages [product photos].
Lyman Turbo Pro 1200 Tumbler, 2 pages [product photos].
Auto-Flo Lyman Turbo 1200 Tumbler, 2 pages [product photos].
RCBS Automatic Primer Tool, pp. 68-71, undated.
"Reloading Manual Number Ten for Rifle and Pistol," The Cartridge Components, SPEER Omark Industries, pp. 28-54.
"Shotshell reloading with a Grabber 76," MEC—Mayville Engineering Company, Inc., pp. 1-12.
Sweeney, P "Gunsmithing: Measure Headspace," Peterson's Rifleshooter, http://www.rifleshootermag.com/gunsmithing/headspace_0612/, 4 pages [Internet Accessed Dec. 11, 2004].
Tenex Precision Co., "Recoil A-Rest-R," 4 pages [product photos].
"Plano Shooters Case, Brown Camo," The Sportman's Guide, http://www.sportmansguide.com/cb/cb.asp?a=148225, The date on which the Plano Shooters Case was first on sale is not known but is believed to be circa 2004, 3 pages [Internet accessed on Oct. 11, 2006].
Precision Shooting, Inc., Bald Eagle Front Rest, The Accurate Rifle, vol. 6, Issue No. 4, May 2003, p. 47.
Sinclair International, Sinclair Shooting Rests, Products for the Precision Shooter, 2002, Issue No. 2002-B pp. 76-78.
Device manufactured by Shooters Ridge, a division of ATK, and available at least by late 2005, 1 page.
"Uncle Bud'S Udder Bag," http:www.unclebudscss.com/pages/Udder%20Bags.html, 2 pgs. [Internet accessed on Feb. 14, 2006].
"Uncle Bud'S Bull Bags," http:www.unclebudscss.com/pages/Bulls%20bags.html, 2 pgs. [Internet accessed on Feb. 14, 2006].
Millett, "BenchMaster Shooting Rests," 1 page, Undated.
Protektor Model, "The Original Leather Rifle and Pistol Rest," http://www.protektormodel.com/, 12 pages [Internet accessed on Feb. 14, 2006].
Edgewood Shooting Bags Catalog, http://www.edgebag.com/catalog.php, 7 pages [Internet accessed on Feb. 14, 2006].
Canadian Camo, "Gun Rest," http://media5.magma.ca/www.canadiancamo.com/catalog/product_info.php?products_id= . . . , 2 pages [Internet accessed on Feb. 13, 2006].
Caldwell Shooting Supplies, 2006 Catalog, pp. 18, 5, 12, 14 and 15.
Cabela's, "Secure Bench Rest," http://www.cabelas.com/cabelas/en/templates/links/link.jsp;jsessionid=4F0LP0OW2HMRLLAQBBISCOF.., ® 1996-2008, 2 pages [Internet accessed on Aug. 6, 2008].
Cabela's, "Premier Rifle Rest," http://www.cabelas.com/cabelas/en/templates/links/link.jsp?id=0020904227856a&type=product&cmCat=.., ® 1996-2008, 2 pages [Internet accessed on Aug. 6, 2008].
Cabela's, "Sharp Shooter Rifle Rest," http://www.cabelas.com/cabelas/en/templates/links/link.jsp?id=0005816222738a&type=product&cmCat=, ® 1996-2008, 2 pages [Internet accessed on Aug. 6, 2008].
Cabela's, "Nitro Shoulder Shield Rest," http://www.cabelas.com/cabelas/en/templates/links/link.jsp?id=0040862228231a&type=product&cmCat=, ® 1996-2008, 2 pages [Internet accessed on Aug. 6, 2008].
Cabela's, "Sure Shot Shooting Vise/Rest," http://www.cabelas.com/cabelas/en/templates/product/standard-item.jsp?id=00348272277 . . . , ® 1996-2008, 2 pages [Internet accessed on Jul. 15, 2008].
Cabela's, "BenchBuddy® Gun Rest," http://www.cabelas.com/cabelas/en/templates/links/link.jsp?id=0005819221954a&type=product&cmCat=, ® 1996-2008, 2 pages [Internet accessed on Aug. 6, 2008].
Cabela's, "Elite Rifle Rest," http://www.cabelas.com/cabelas/en/templates/links/link.jsp?id=0005817227855a&type=product&cmCat=, ® 1996-2008, 2 pages [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, ® 1996-2008, 2 pages [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, ® 1996-2008, 2 pages [Internet accessed on Aug. 6, 2008].
Cabela's, "Hyskore® Ultimate Sighting Rest," http://www.cabelas.com/cabelas/en/templates/links/link.jsp?id=0024152226083a&type=product&cmCat=, ® 1996-2008, 2 pages [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pages [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pages [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pages [Internet accessed on Aug. 6, 2008].
MidwayUSA, "ADG Rifle Shooting Rest," http://www.midwayusa.com/eproductpage.exe/showproduct?saleitemid=992071&t=11082005, 2005, 3 pages [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pages [Internet accessed on Aug. 6, 2008].
MidwayUSA, "Stoney Point Bench Anchor Rifle Shooting Rest," http://www.midwayusa.com/eproductpage.exe/showproduct?saleitemid=347174&t=11082005, 2005, 2 pages [Internet accessed on Aug. 6, 2008].
MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].
MidwayUSA, "Shooters Ridge Steady Point Rifle Shooting Rest and Vise," http://www.midwayusa.com/eproductpage.exe/showproduct?saleitemid=341095&t=11082005, 2005, 4 pages [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 4 pages [Internet accessed on Aug. 6, 2008].
MidwayUSA, "Hyskore® Swivel Varmint Rifle Shooting Rest," http://www.midwayusa.com/eproductpage.exe/showproduct?saleitemid= 587606&t=11082005, 2005, 3 pages [Internet accessed on Aug. 6, 2008].
MidwayUSA, "Hyskore® dangerous Game Rifle Shooting Rest," http://www.midwayusa.com/eproductpage.exe/showproduct?saleitemid=729197&t=11082005, 2005, 3 pages [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin . . . , 15 pages [Internet accessed on Jul. 21, 2008].
Basspro.com, "Bass Pro Shops Outdoors Online: Offering the best in Fishing, Hunting and Outdoor Products," http://www.basspro.com/ webapp/wcs/stores/servlet/Product__10151__-1__10001__95064 SearchResults, 2 pages [Internet accessed on Aug. 6, 2008].
Amazon.com, "CTK® P3 Ultimate Shooting Rest," Sports & Outdoors, http://www.amazon.com/CTK%C2%AE-P3-Ultimate-Shooting-Rest/dp/ . . . , 1 page [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/Steady-Accessories-Hunting-Shooting-Fishin . . . , 1 page [Internet accessed on Jul. 22, 2008].
Amazon.com, "Stoney Point Adjustable Shooting Rest w/Bag," Sports & Outdoors, http://www.amazon.com/Stoney-Point-Adjustable-Shooting-Rest/dp/B0.., 1 page [Internet accessed on Jul. 22, 2008].
CTK Precision, All Products, http://www.ctkprecision.com/index.asp?PageAction=VIEWCATS&Cate.., 3 pages [Internet accessed on Jul. 22, 2008].
CTK Precision, "P3 Ultimate Shooting Rest," http://www.ctkprecision.com/index.asp?PageAction=VIEWPROD&ProdOID=2, 3 pages [Internet accessed on Jul. 18, 2008].
Big Boy Gun Toys, "Shooting Rest," http://www.bigboyguntoys.com/shootingrest.htm, 1 page [Internet accessed on Jul. 18, 2008].
Boyt Harness Company, Product Catalog, http://www.boytharness.com/catalog/index.php?cPath=22, 2 pages [Internet accessed on Jul. 21, 2008].
Joe's, "Shooter's Ridge Steady Point Shooting Rest," http://www.joessport.com/product/index.jsp?productID=3155005&cp=726872&parentpag.., Item No. 3155005, 1 page [Internet accessed Jul. 17, 2008].
Cabela's, "Shooting Benches & Portable Rifle Shooting Bench Rest," http://www.cabelas.com/ssubcat-1/cat20793.shtml, 3 pages [Internet accessed Jul. 18, 2008].
"Gun Rest—Shooting Rest—Rifle Rests," http://www.jexploreproducts.com/gunrests-shootingrests.htm, 6 pages [Internet accessed Jul. 18, 2008].
E. Arthur Brown Company, "A Shooting Rest that Really Works..," http://www.eabco.com/TargetShooting01.html, © 2007-2008, 1 page [Internet accessed Jul. 18, 2008].
MacksPW.com, "Desert Mountain Bench Master Rifle Rest," http://www.macksqw.com/Item—i—DESBM1, © 2004-2008, 1 page [Internet accessed Jul. 22, 2008].
Hyskore, "Rest—Dangerous Game Machine Rest," Hyskore Rest, Professional firearm rests, http://www.hyskore.com/rests.htm, 2 pages [Internet accessed Jul. 21, 2008].
Shooters Ridge, "Shooting Rest with Gun Vise," http://www.shootersridge.com, 1 page [Internet accessed Jul. 17, 2008].
Shooters Ridge, "Deluxe Rifle Rest," http://www.shootersridge.com, 1 page [Internet accessed Jul. 21, 2008].
Chastain, R. "Load 'em Up!" About.com: Hunting/Shooting, http://hunting.about.com/od/reloadinfo/a/aaloademup__2htm, 6 pages [Internet accessed on Aug. 31, 2007].
Harris, J. et al., "The Art and Science of Annealing," http://www.6mmbr.com/annealing.html, © 2005, 13 pages [Internet accessed on Aug. 13, 2007].
Cork Industries, Inc., "Double Bumping Coating Applications," Cork Tech TalkNews, Feb. 1997, 2 pages.
Grafix® Plastics, http://www.grafixplastics.com/plastic__film__g.asp?gdid=CK-5-__7gnY4CFRVNhgodjFhfSQ, 29 pages [Internet accessed on Aug. 30, 2007].
International Search Report and Written Opinion; International Patent Application No. PCT/US07/76587; Filed: Aug. 22, 2007; Applicant: Battenfeld Technologies, Inc.; Mailed on Jul. 30, 2008.
International Search Report and Written Opinion; International Patent Application No. PCT/US07/83674; Filed: Nov. 5, 2007; Applicant: Battenfeld Technologies, Inc.; Mailed on Jun. 11, 2008.
Non-Final Office Action; U.S. Appl. No. 10/865,595; Mailed on Jun. 7, 2006, 8 pages.
Final Office Action; U.S. Appl. No. 10/865,595; Mailed on Apr. 3, 2007, 10 pages.
Non-Final Office Action; U.S. Appl. No. 11/339,863; Mailed on Sep. 23, 2008, 7 pages.
Non-Final Office Action; U.S. Appl. No. 11/206,430; Mailed on May 21, 2007, 12 pages.
Final Office Action; U.S. Appl. No. 11/206,430; Mailed on Oct. 29, 2007, 13 pages.
Non-Final Office Action; U.S. Appl. No. 11/206,430; Mailed on May 14, 2008, 10 pages.
Non-Final Office Action; U.S. Appl. No. 11/271,100; Mailed on Mar. 26, 2008, 9 pages.
Final Office Action; U.S. Appl. No. 11/271,100; Mailed on Sep. 22, 2008, 8 pages.
Non-Final Office Action; U.S. Appl. No. 11/311,530; Mailed on Feb. 13, 2007, 10 pages.
Non-Final Office Action; U.S. Appl. No. 11/505,784; Mailed on Dec. 26, 2007, 14 pages.
Non-Final Office Action; U.S. Appl. No. 11/507,683; Mailed on Sep. 18, 2008, 8 pages.
Non-Final Office Action; U.S. Appl. No. 11/679,136; Mailed on Aug. 18, 2008, 6 pages.
Non-Final Office Action; U.S. Appl. No. 11/679,136; Mailed on Aug. 28, 2008, 8 pages.
Non-Final Office Action; U.S. Appl. No. 11/844,980; Mailed on Aug. 21, 2008, 8 pages.
Non-Final Office Action; U.S. Appl. No. 11/846,408; Mailed on Aug. 18, 2008, 8 pages.
U.S. Appl. No. 12/209,113, filed Sep. 11, 2008, Potterfield et al.
International Search Report and Written Opinion; International Patent Application No. PCT/US07/76440; Filed: Aug. 21, 2007; Applicant: Battenfeld Technologies, Inc.; Mailed on Sep. 30, 2008.
Non-Final Office Action; U.S. Appl. No. 11/679,100; Mailed on Oct. 16, 2008, 11 pages.

* cited by examiner

SYSTEM AND CONTAINER FOR ORGANIZING AND CARRYING TOOLS AND TOOL SETS

CROSS-REFERENCE TO RELATED APPLICATION

This application claims the benefit of U.S. Provisional Patent Application No. 60/951,086, filed Jul. 20, 2007, which is incorporated by reference herein. This application is related to U.S. Pat. No. D524,541 filed Oct. 28, 2004, which is incorporated by reference herein.

TECHNICAL FIELD

The present disclosure is directed generally to containers for carrying tools, and specifically to tool organization systems with corresponding tool location guides.

BACKGROUND

Gunsmiths, craftsmen, builders, mechanics, etc. use a variety of tools in their respective trades. Several tools are small and easily misplaced during use and storage. In addition, projects can require the use of several members of a tool set. A number of tool organizational containers are available to keep the tools as a set and/or available for use when needed. In addition, tool organizational systems can often be provided in portable tools cadies for easy transport and use at a variety of locations.

Tool organizational containers often come with a shell surrounding an interior tool retaining portion having a number of holes or recesses for accommodating the tools in an organized fashion. The holes are often arranged in a predictable pattern based on size and shape to facilitate retrieval of the appropriate tool when needed. For example, screwdriver bits are often arranged in linear fashion from smallest diameter to largest diameter. Furthermore, bits that can be adapted for interchangeable co-action with a screwdriver can be grouped together based on the bit drive design. Drive designs can consist of a square drive, a torx drive, a Phillips drive, a hex drive, a slotted drive, a Pozidriv drive, a tri-wing drive, a torq-set drive, a spanner drive, a socket drive, and the like. Therefore, a gunsmith, for example, would need to know which drive design and which size bit is required for a project before being able to retrieve and replace the correct bit, or other tool, from the tool organization container.

DETAILED DESCRIPTION

A. Overview

Figure 1:
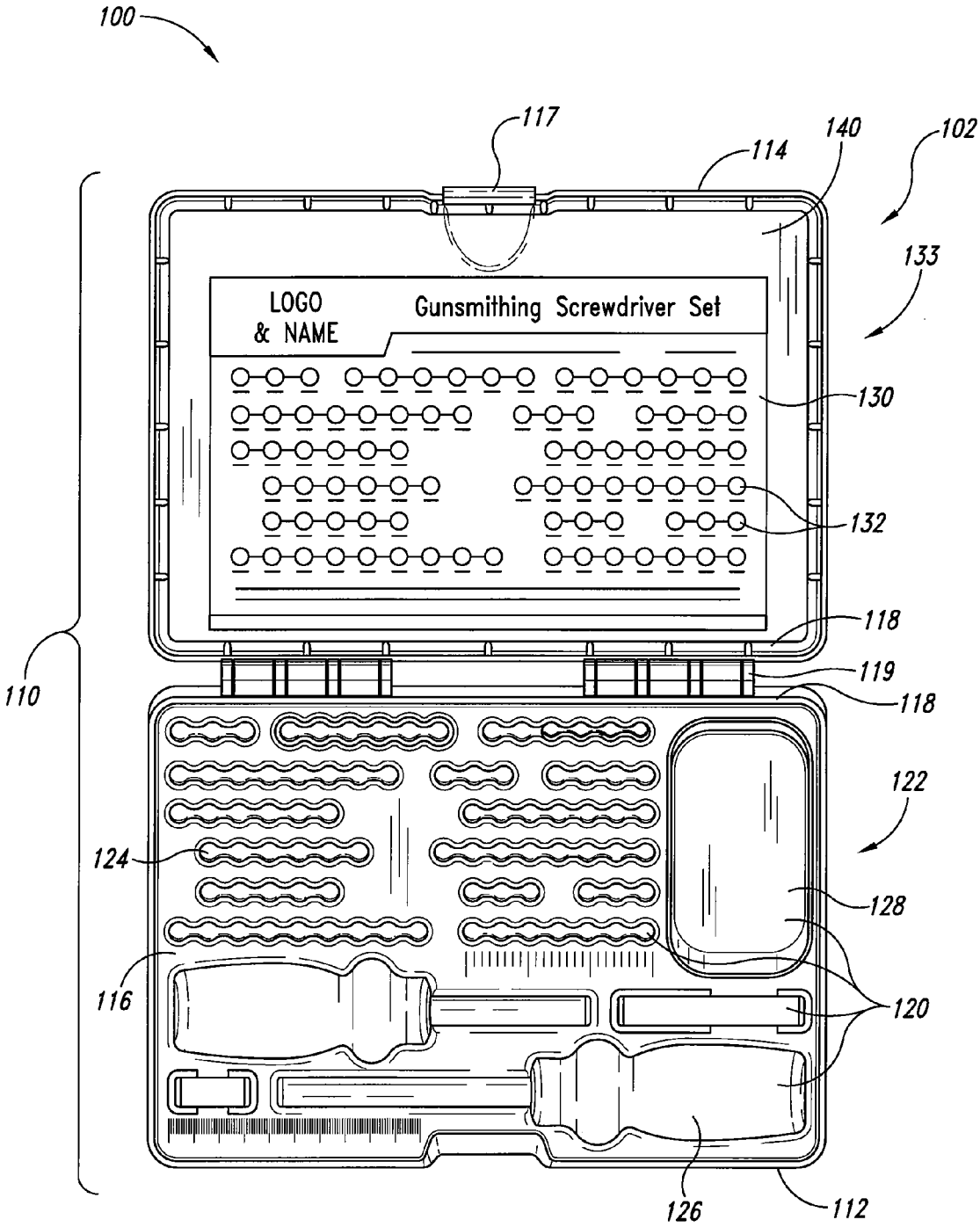
FIG. 1 is a top view of a tool container in an open position illustrating tool recesses and a tool position guide in accordance with an embodiment of the invention.

The following disclosure describes several embodiments of systems and containers for organizing and carrying tools and tool sets. One aspect of the invention is directed to systems and containers for efficiently organizing tools for specific work tasks, such as gunsmith tools, etc.

In one embodiment, a container for carrying and organizing tools includes a housing having a base portion and a lid portion. The lid portion can be pivotally attached to the base portion. The container can also include a plurality of recesses disposed in an internal portion of the container in a recess pattern. The recesses can be configured to releasably retain the tools in the housing. The container also includes an insertable tool position guide having a plurality of images in an image pattern, wherein the image pattern can correspond to the recess pattern. In addition to tool positional information, the tool position guide can also communicate tool identification information.

In another embodiment, a tool storage assembly includes a housing, a first tool module, and a first position label. The housing can be configured to transition between an open position and a closed position and include an interior compartment for retaining a plurality of tools. The first tool module can be configured to be received in the housing. The first tool module can include a plurality of first recesses for releasably retaining the tools in a first recess pattern. The first position label can be configured to be received in the housing and can include a plurality of first images in a first image pattern. The first image pattern can correspond to the first recess pattern. The first position label can also communicate information corresponding to tool placement in the first tool module.

Another aspect of the invention is directed to gunsmith containers. In one embodiment, a gunsmith container includes a base portion having a raised pallet configured to be housed in the container. The gunsmith container also includes a lid portion coupled to the base portion along one edge region with a hinge. A plurality of recesses can be formed in the pallet in a recess pattern. The recesses can be configured to releasably engage tools and tool accessories. An insertable tool position guide can be attached to the lid portion. The guide can have a plurality of images in an image pattern, wherein the image pattern corresponds to the recess pattern, and wherein the tool position guide includes positional information relating to the tools and tool accessories.

Specific details of several embodiments of the invention are described below with reference to tool containers and tool organizational systems. Several details describing well-known structures or processes often associated with tools and tool containers are not set forth in the following description for purposes of brevity and clarity. Also, several other embodiments of the invention can have different configurations, components, or procedures than those described in this section. A person of ordinary skill in the art, therefore, will accordingly understand that the invention may have other embodiments with additional elements, or the invention may have other embodiments without several of the elements shown and described below with reference to FIGS. 1-13C.

Where the context permits, singular or plural terms may also include the plural or singular term, respectively. Moreover, unless the word "or" is expressly limited to mean only a single item exclusive from other items in reference to a list of at least two items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same features and/or other types of features and components are not precluded.

B. Embodiments of Containers for Carrying and Organizing Tools and Tool Sets

FIG. 1 is a top view of a system 100 for carrying and organizing tools (not shown) in accordance with one embodiment of the invention. The illustrated tool organizational system 100 includes a container 102 with a housing 110 having a base portion 112 and a lid portion 114. The system 100 can also include an internal portion 116 having a plurality of recesses 120 configured to releasably retain tools. The system 100 can further include an insertable tool position guide 130 configured to communicate information 132 pertaining to the tool organizational system 100.

The lid portion 114 can be pivotally attached to the base portion 112 such that the lid portion 114 can transition between open and closed positions. For example, the housing 110 can provide a secured and enclosed container 102 for retaining and carrying tools when the lid portion 114 is positioned to cover the base portion 112. When the lid portion 114 pivots to the open position, the internal portion 116 can be accessed and the tools can be retrieved from and replaced to the corresponding recesses 120.

The lid portion 114 can cover the base portion 112 to form an enclosed interior cavity (not shown). In one embodiment, the housing 110 can include a latch mechanism 117 configured to releasably secure the lid portion 114 to the base portion 112 in the closed position. The lid portion 114 can be released from the base portion 112 to expose the interior cavity and provide access to the internal portion 116 with the recesses 120. In one embodiment, the lid portion 114 can pivot with respect to the base portion 112 to the open position. However, in other embodiments, the lid portion 114 may not be coupled to the base portion 112 when in the open position.

In one embodiment, the housing 110 may be formed as a single unit. In this embodiment, the lid portion 114 and base portion 112 can be integrally connected through a living hinge (not shown) that allows the lid portion 114 to pivot relative to the base portion 112. A blow-molding process, in which hollow plastic parts can be formed, can be used to manufacture such an embodiment. In another embodiment, the base and lid portions 112, 114 can be formed separately. In this embodiment, the lid portion 114 can be coupled to the base portion 112 along one edge region 118 with a movable hinge 119 configured to allow the lid portion 114 to rotate about the hinge 119 with respect to the base portion 112. In a further embodiment, the lid portion 114 can be separate from the base portion 112 when the container 102 is in the open position. An injection molding process can be used to manufacture the housing 110 in these embodiments. While these molding processes are suitable for containers 102 made from plastics, such as thermoplastics (e.g., polystyrene, nylon, polyethylene, PVC, etc.), other manufacturing processes can be used as well as variety of materials (e.g., metal, wood and other organic compounds, ceramics, etc.). Furthermore, in embodiments in which the base and lid portions 112, 114 are manufactured separately, the materials used to form these portions 112, 114 can be the same or different.

The internal portion 116 can be formed as part of the base portion 112 during the molding process. Alternatively, the internal portion can be formed separately from the lid portion 114 and base portion 112. The separately-formed internal portion 116 can be permanently incorporated into the housing 110 or can be configured to be releasably incorporated within the internal cavity (described in more detail below).

Figure 2:
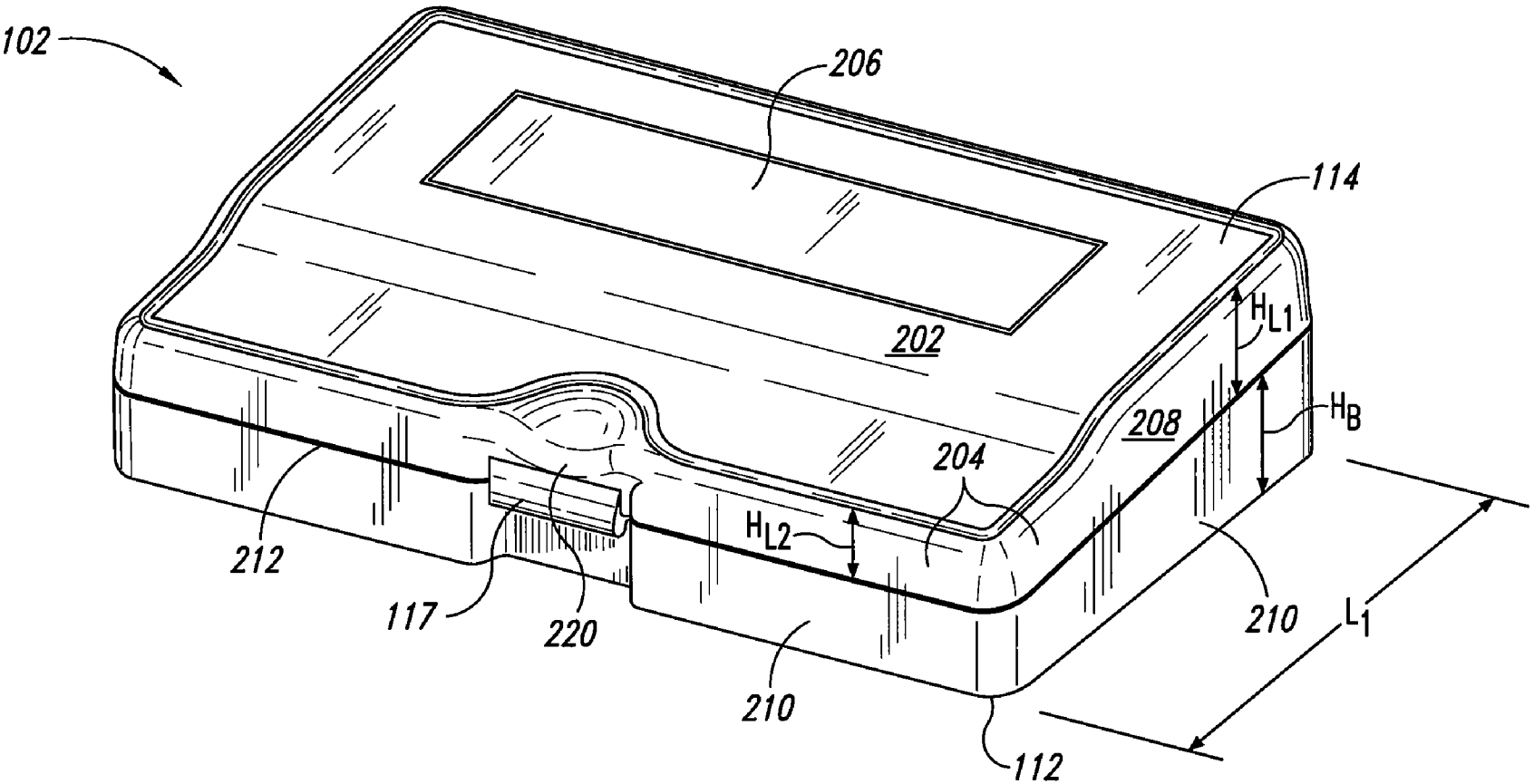
FIG. 2 is a front perspective of a tool container illustrating the lid portion covering the base portion in accordance with an embodiment of the invention.

FIGS. 2-6 show several views of the tool container 102 in the closed position. For example, FIG. 2 is a front perspective view of a tool container 102 illustrating the lid portion 114 covering the base portion 112 in accordance with an aspect of the invention. The container 102 includes the lid portion 114 having an upper outer surface 202 and a plurality of lid side walls 204 having a lid height $H_L$. In one embodiment, the upper outer surface 202 of the lid portion 114 can be generally planar. However, in other embodiments, such as shown in FIGS. 2-6, the upper outer surface 202 can be undulating or tapered. In these embodiments, the lid side walls 204 can have more than one lid height $H_L$ (shown individually as $H_{L1}$ and $H_{L2}$).

Figure 3:
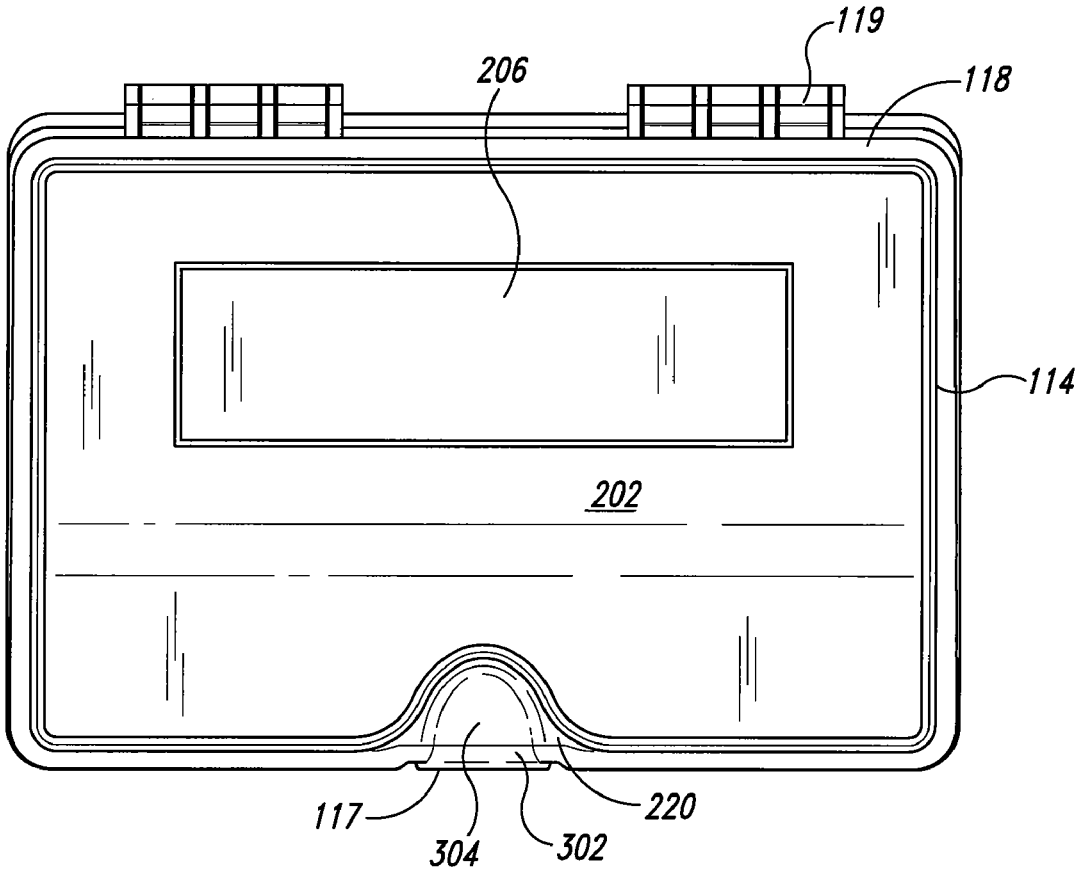
FIG. 3 is a top view of the tool container of FIG. 2.

FIGS. 2 and 3 illustrate the upper outer surface 202 of the lid portion 114. The upper outer surface 202 of the lid portion 114 can contain a label region 206 configured to contain information related to identification of the container 102 or other information. In one embodiment, the label region 206 may have a raised texture formed during the manufacturing process. For example, a company name and/or logo can be molded onto the label region 206. In another embodiment, the label region 206 may have a generally planar surface for applying a label (not shown) with adhesive or other adhering substance. In a further embodiment, the label region 206 and/or the lid portion 114 can be formed of a transparent material such that the interior portion 116 is visible through the lid portion 114. One of ordinary skill in the art will recognize various sizes and shapes of labeling regions 206 as well as various methods of adhering or forming information and designs to an outer surface (e.g., upper outer surface 202) of the container 102. For example, the labeling region 206 can be formed on an outer surface 208 of the lid side walls 204, or on other outer surfaces of the container 102.

Figure 4:
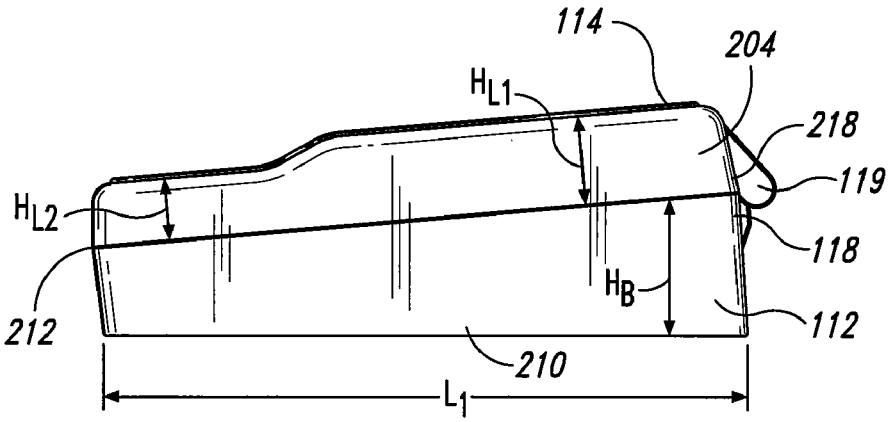
FIG. 4 is side elevation view of the tool container of FIG. 2.

The container 102 also includes a base portion 112 having a lower outer surface (not shown) and a plurality of base side walls 210. In one embodiment, the base side walls 210 can have a base height $H_B$. In other embodiments, the height $H_B$ of the base side walls 210 can be varied, as shown in FIGS. 2 and 4, such that the height $H_B$ of the base side walls 210 are tapered or sloped along a length $L_1$ of the container 102. In further embodiments, the base side walls 210 can have other variations in height $H_B$ along the length $L_1$. In one embodiment, the base height $H_B$ can be greater that the lid height $H_L$. In other embodiments, however, the base height $H_B$ can be generally the same or smaller than the lid height $H_L$.

Figure 5:
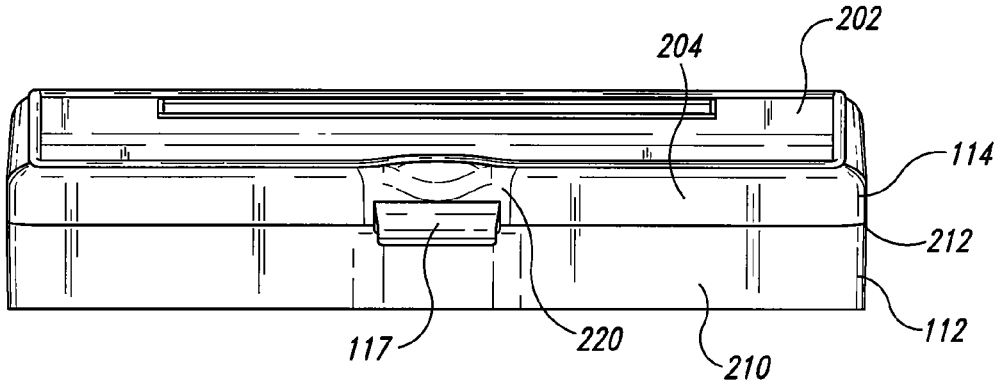
FIG. 5 is a front perspective of the tool container of FIG. 2 illustrating a latch mechanism in accordance with an embodiment of the invention.
Figure 6:
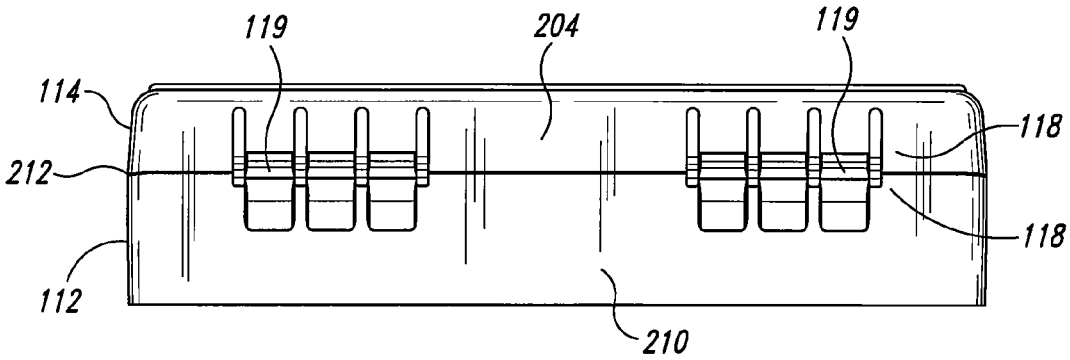
FIG. 6 is a back perspective of the tool container of FIG. 2 illustrating a hinge in accordance with an embodiment of the invention.

As shown in FIGS. 2 and 4-6, the lid side walls 204 meet the base side walls 210 along exposed edges 212 while in the container 102 is in the closed position. In another embodiment, not shown, the lid portion 114 may be sized smaller than the base portion 112 such that the lid side walls 204 are surrounded by the base side walls 210, or the lid portion 114 may be sized larger than the base portion 112 such that the base side walls 210 are surrounded by the lid side walls 204 while the container 102 is in the closed position. As shown in FIG. 6, the hinges 119 are configured to couple the lid portion 114 to the base portion 112 and can be positioned to allow the lid portion 114 to pivot to the closed position to form the fully enclosed interior cavity.

The container 102 can also include a latch mechanism 117 for securing the lid portion 114 to the base portion 112 when the container 102 is in a closed position. The latch mechanism 117 can be a clip attached to one of the lid portion 114 or the base portion 112 and configured to pivot to releasably engage the opposite portion when in a closed position. The latch mechanism 117 can also include a snap system, corresponding hook and loop strips, a buckle, etc. FIGS. 2 and 5 illustrate the latch mechanism 117 as positioned along an edge portion 220 of the container 102 opposite the edge region 118 having the hinge 219. In other embodiments, however, the latch mechanisms 117 could be positioned along other edges 220 and or multiple latches 217 could be positioned along multiple edges 220 of the container 102.

FIG. 3 is a top view of the tool container 102 shown in FIG. 2 illustrating an embodiment of a handle 302 that can be integrated in the container 102. The container 102 can contain one or more handles 302 to facilitate moving, opening and/or transporting the tool container 102. In the illustrated embodiment, the lid portion 114 has a hole 304 formed through the edge region 220 to provide an opening for a hand or fingers of a user to grasp the container 102 and/or lift the lid portion 114 relative to the base portion 112 when the latch mechanism 117 is disengaged. Other embodiments of handles 302 can be included. For example, the handle 302 can be straps that are attached to the outer surface 202 of the base or lid portions 112, 114, additional plastic rings or projections formed with the container 102 during the molding process, etc.

Figure 7:
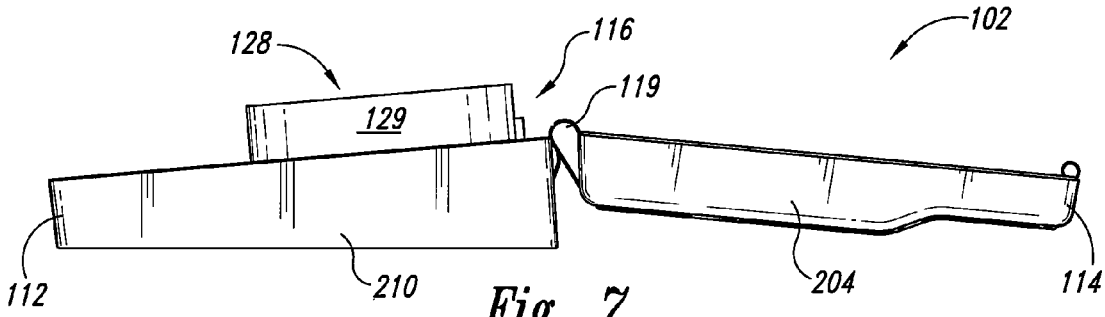
FIG. 7 is side elevation view of the tool container with the lid portion in an open position in accordance with an embodiment of the invention.

FIG. 7 is a side elevation view of the tool container 102 of FIG. 1 with the lid portion 114 in an open position. The illustrated embodiment shows the lid portion 114 pivoted away from the base portion 112 to expose and provide access to the internal portion 116 of the tool container 102. As shown, the hinges 119 can allow the lid portion 114 to rotate and extend away from the base portion 112. In other embodiments, the hinges 119 may limit the pivoting range of the lid portion 114 such that the lid portion 114 rests at an angle less than 180 degrees relative to the base 112 when in the open position. Other embodiments may include brackets or straps attached to the lid and base side walls 204, 210 that limit the pivoting range of the lid portion 114.

Figure 8:
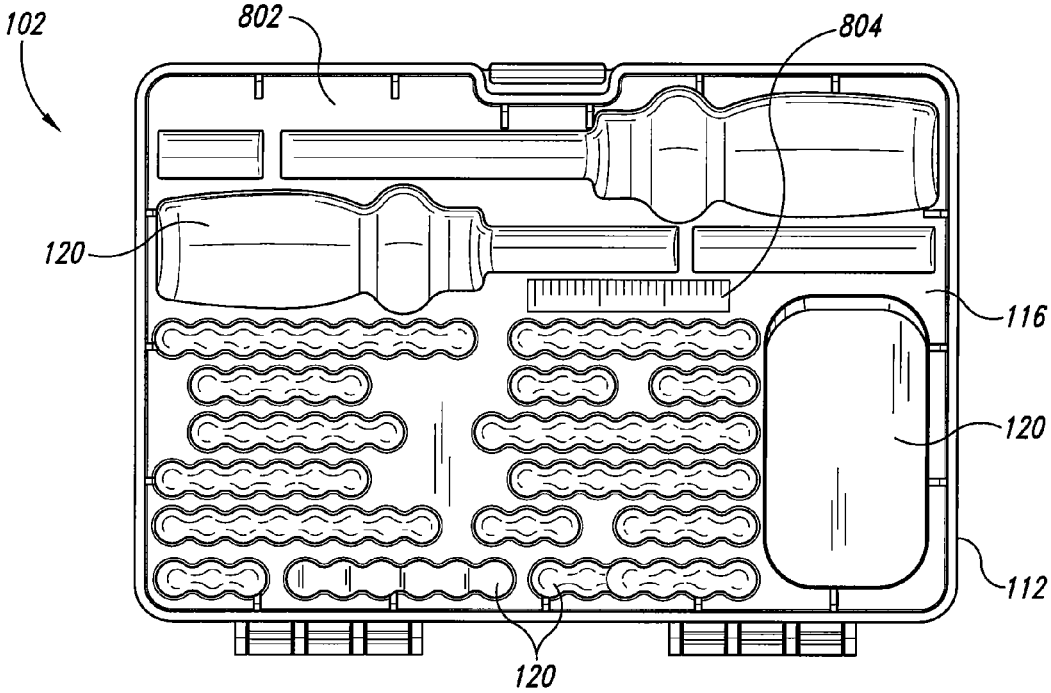
FIG. 8 is a top view of an embodiment of a base portion of a tool container in accordance with an aspect of the invention.
Figure 9:
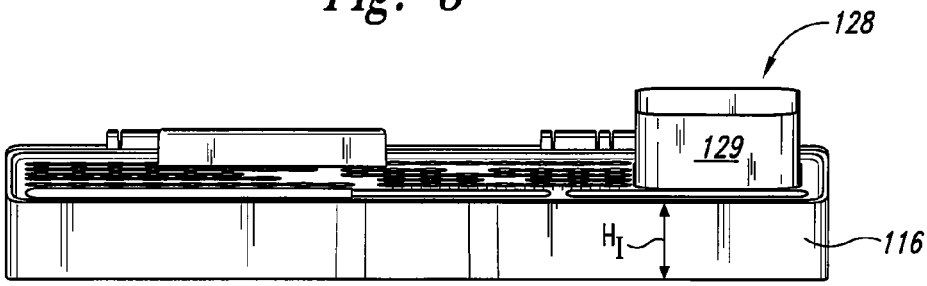
FIG. 9 is a front elevation view of an internal portion having a plurality recesses in accordance with an embodiment of the invention.

FIG. 8 is a top view of an embodiment of the base and internal portions 112, 116 of the tool container 102 in accordance with an aspect of the invention. As shown, the internal portion 116 can be formed as an integral part of the base portion 112 during the manufacturing process. In this embodiment, the internal portion 116 can include a raised pallet 802 or platform having the plurality of recesses 120 disposed therein. The raised pallet can also include measuring scales 804 having metric and U.S. customary units. FIG. 9 illustrates another embodiment of the internal portion 116 in which the internal portion 116 is separate module that can be fitted and/or placed inside of the base portion 112 and enclosed inside of the interior cavity created between the base and lid portions 112, 114 of the housing 110. The internal portion 116 can have an internal height $H_I$ generally similar to the base height $H_B$. However, in other embodiments, the internal height $H_I$ can be greater or less than the base height $H_B$. In these embodiments, the internal height $H_I$ would be less than the sum of the base height $H_B$ and the lid height $H_L$.

Referring back to FIG. 1, the plurality of recesses 120 can be disposed in the internal portion 116 in a recess pattern 122. In one embodiment, the recesses 120 can include a plurality of holes 124 disposed in the internal portion 116 configured to retain tools, such as screwdriver bits, socket bits, etc. In some embodiments, the holes 124 can be formed such that the bottoms of the holes 124 are enclosed and the holes 124 can have a variety of depths. In other embodiments, the holes 124 can penetrate the internal portion 116 and have open ends. In these embodiments, the holes 124 can have apertures with varying widths or with varying aperture geometries that prevent bits from falling through the holes 124. In further embodiments, the holes 124 can be tapered such that the bits, or other tools, are prevented from falling through. Additionally the holes 124 can be formed in the internal portion 116 as multiple holes 124 chained together, as shown in FIG. 1. In this embodiment, the aperture geometry can make contact with multiple points on a bit, but not completely surround the bit. For example, the aperture geometry can be configured to contact a hexagonal bit at four points such that the bit is restrained in the hole 124 and prevented from becoming loose inside the interior cavity during storage or transport of the tool organizational system 100. In other embodiments, however, the holes 124 can be formed as separate holes 124 configured to retain a single bit or other tool.

In addition to holes 124, the recesses 120 can also include one or more elongated impressions 126 configured to accommodate an elongated tool, such as a screwdriver, socket wrench, and the like. The elongated impressions 126 can be provided with a retaining mechanism (not shown) to prevent the elongated tool from unassisted dislocation from the elongated impression 126. Retaining mechanisms can include, for example, retaining clips. Other examples can include retaining straps secured by snaps, corresponding hook and loop strips, tension springs, etc. Additionally, the elongated impressions 126 can include foam inserts that expand around the inserted tool and prevent the tool from becoming dislocated.

Other types of recesses 120 can also be incorporated in the internal portion 116. For example, the internal portion 116 may include a general holding cup 128 as shown in FIG. 1. The general holding cup 128 can have elevated sides 129, as shown in FIGS. 7 and 9, to hold a variety of tools and or workpieces while the lid portion 114 is in the open position. Additionally, the elevated sides 129 can be configured to come into contact with an inner surface 140 of the lid portion 114 when the container 102 is in the closed position, thereby holding loose tools and/or workpieces in the cup 128 and preventing them from getting dislodged or misplaced in other portions of the container 102. In some embodiments, the inner surface 140 of the lid portion 114 can be tapered and/or vary in its separation distance from the internal portion 116. One advantage of these embodiments is that the lid portion 114 can be positioned to prevent tools, having varying lengths and over-all sizes, from becoming dislodged from their respective recesses 120 while in transport. One of ordinary skill in the art will recognize other shaped recesses 120 and tool retaining devices that can be incorporated or formed in the internal portion 116 of the container 102.

As described above, the recesses 120 can be formed in the recess pattern 122. Conventional recess patterns are configured to align the tools based on drive design (e.g., square drive, a torx drive, a Phillips drive, etc.), length (e.g., ¼ inch, ½ inch, etc.), width, etc. These conventional tool placement patterns are not always useful for users performing specific tasks, working with specific tools (e.g., gunsmith tools), etc. Additionally, the placement of the tools within the containers does not provide the user with a way of finding the desired tool in the most efficient manner. In contrast to the conventional tool containers, the recess pattern 122 of the present invention can be created in a variety of useful configurations. The recess pattern 122 can be non-symmetrical or it can be symmetrical. For example, the recess pattern 122 can be one or more than one recognized or unrecognized shapes. The recesses 120 can be formed to retain specific tools and members of specific tool sets designed for particular tasks. In accordance with an embodiment of the invention, the recess pattern 122 can provide a tool organizational container 102 having tools organized and grouped by a variety of characteristics. For example, the tools or tool pieces can be positioned in patterns 122 based on how commonly the tools are used, based on what tasks the tools are used for, based on whether the container 102 was designed for a right-handed or left-handed user, etc.

Figure 10:
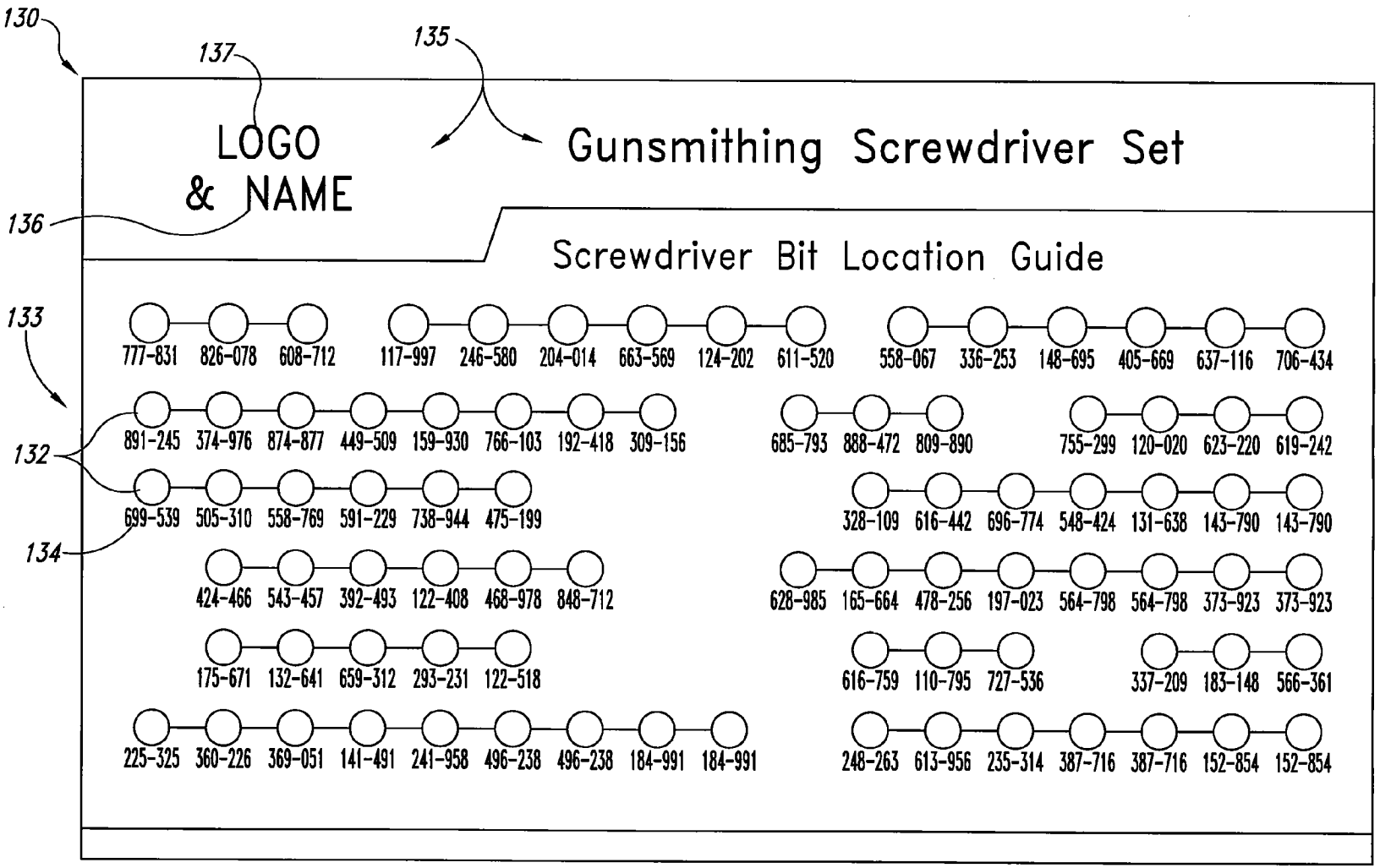
FIG. 10 is a plan view of the tool position guide of FIG. 1.

As shown in FIG. 1, the tool organizational system 100 is also provided with the insertable tool position guide 130. The tool position guide 130 can have a plurality of images 132 in an image pattern 133. The image pattern 133 can correspond to the recess pattern 122 with each image 132 representing a particular recess 120. In this manner, tools retained in the recesses 120 can be identified by referring to the tool position guide 130. FIG. 10 is an enlarged view of the tool position guide 130 shown in the system 100 of FIG. 1. The tool position guide 130 can also include tool identification information 134. In one embodiment, each of the images 132 can also include tool information 134 specific to the tool to be retained in the corresponding recess 120 of the internal portion 116. For example, the tool information 134 can include tool type and size. In other embodiments, the guide 130 can also include other information 134 about the tools such as drive design, name, uses for the tool, product serial number, etc. In further embodiments, the tool position guide 130 can also include general information 135 such as the manufacture's or supplier's company name 136, company logo 137, contact information, reorder information, etc. In another embodiment, not shown, the tool position guide 130 can include information on a front surface and a back surface. When the tool position guide 130 is used with a housing 110 having at least a transparent portion, the back surface information can be visible when the lid portion 114 is in the closed position.

In one aspect of the invention (not shown), the tool position guide 130 can have images 132 and/or information 134, 135 in a variety of colors. For example, the images 132 and/or information 134, 135 presented on the guide 130 can be printed, stamped, embossed, etc. on the guide 130 in colors other than black or white. Colors, such as red, orange, blue, green, etc. can be useful for product/logo recognition as well as can be attractive and eye-catching when the user is repeatedly exposed to the guide 130. Furthermore, the images 132 can be color-coded based on useful tool characteristics such as size, drive design, task-related features, etc. The guide 130 can also include a grease-resistant and/or oil resistant outer surface (not shown) protecting at least a portion of the guide 130. In this embodiment, the guide 130 having the plurality of images 132 and tool information 134 can be smudge-proof while working with grease and/or oil. For example, the guide 130 may be laminated to protect printed information 134, 135. In another embodiment, the guide 130 can be provided with a markable surface (not shown) having a writable surface. In this embodiment, a user can mark the guide 130 with user-specific notations, information, tool and task tips, and the like.

As shown in FIG. 1, the tool position guide 130 can be an insertable label that attaches to an inner surface of the container 102 or housing 110. For example, the label can be attached to the inner surface 140 of the lid portion 114 so that a user can refer to the guide 130 when the lid portion 114 is in the open position. Alternatively, the label can be attached to the upper outer surface 202 of the lid portion 114, or other outer surface of the housing 110. In another embodiment, the label can be attached to the internal portion 116 of the container 102. In this embodiment, the guide 130 can be provided with holes (not shown) instead of images 132 that are aligned and coordinate with the recesses 120 such that the label can overlay the internal portion 116 without blocking the access to the recesses 120. Furthermore, the guide holes can be associated with tool information 134 specific to the tool held in the corresponding recess 120.

The tool position guide 130 can be attached to the container 120 with an adhesive, retaining clips or slots provided on the container 102, corresponding magnetic components, corresponding hook and loop strips, etc. In another embodiment, the tool position guide 130 can be made from a static adhering material configured to adhere to a surface of the container 102. In some embodiments, the tool position guide 130 can be removable and reusable. In other embodiments, the tool position guide 130 can be replaceable. In still further embodiments, the tool position guide 130 can be reconfigurable as needed to correspond accurately with the recesses 120 and the tools retained by the recesses 120.

Figure 11:
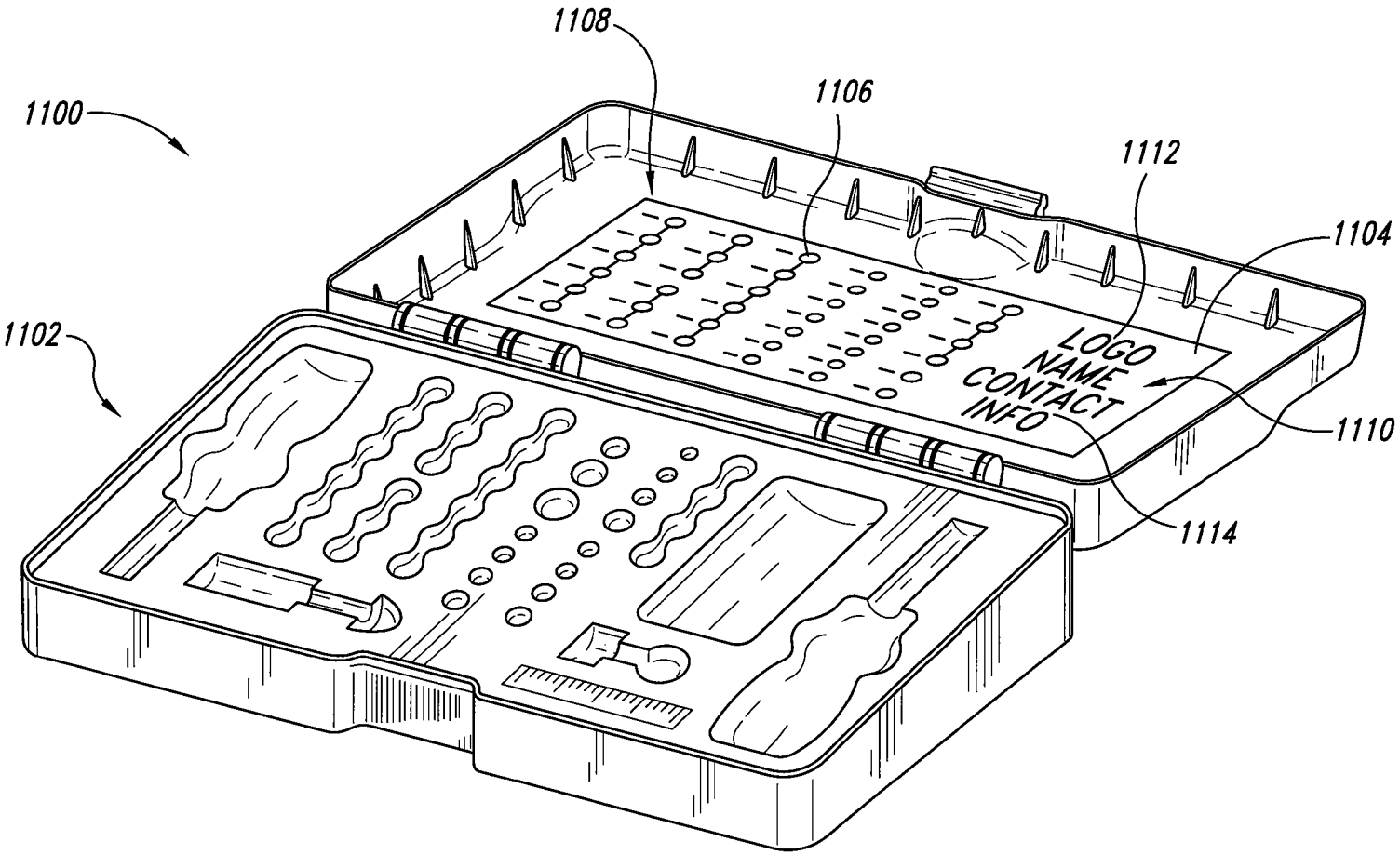
FIG. 11 is front perspective view of another embodiment of a tool container in accordance with an aspect of the invention.
Figure 12:
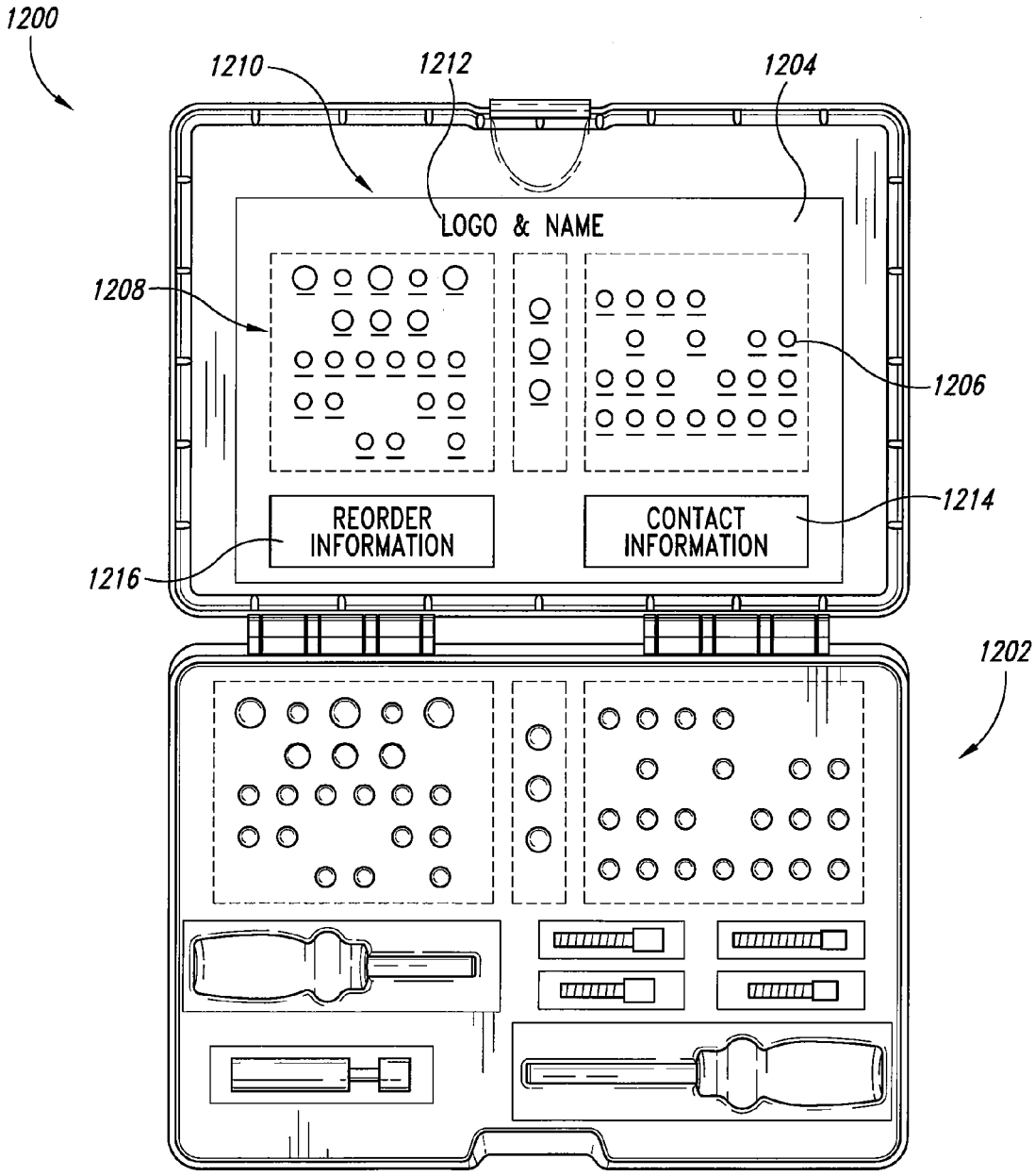
FIG. 12 is a top view of a further embodiment of a tool container in accordance with an aspect of the invention.

One advantage of the invention having the tool recesses 120 formed in non-conventional recess patterns 122 and a corresponding tool position guide 130 is that the recesses 120 can be configured in a variety of patterns 122 conditioned to be task-specific, tool-specific, user-customizable, and efficient during use, etc., while still being able to logically designate tool position during retrieval from and replacement back into the tool container 102. For example, FIGS. 11 and 12 illustrate additional embodiments of tool organizational systems 1100 and 1200. Specifically, the recess patterns 1102, 1202 in these systems 1100, 1200 are different from the recess pattern 122 presented in the system 100 illustrated in FIG. 1. The systems 1100 and 1200 are also provided with tool positional guides 1104, 1204 having a plurality of images 1106, 1206 in image patterns 1108, 1208 corresponding to the recess patterns 1102, 1202. One of ordinary skill in the art will recognize additional recess patterns and insertable tool position guides having corresponding image patterns.

As described above, another advantage is that the guides 1104 and 1204 can also contain company specific information 1110, 1210, including marketing information such as logo 1112 and 1212, contact information 1114 and 1214, reorder information 1216, etc. Specifically, because the guides 130, 1104 and 1204 are insertable into the interior cavity or can be adhered to an outer surface of the container 102, the company-specific information 135, 1110 and 1210 and brand recognition can be maintained with the system 100. Furthermore, the guides 130, 1104 and 1204 can be replaced, removed, and reused in several aspects of the invention. These aspects can improve efficiency during tool use or the duration of a project, as well as reduce frustration when attempting to locate specific tools.

Figure 13A:
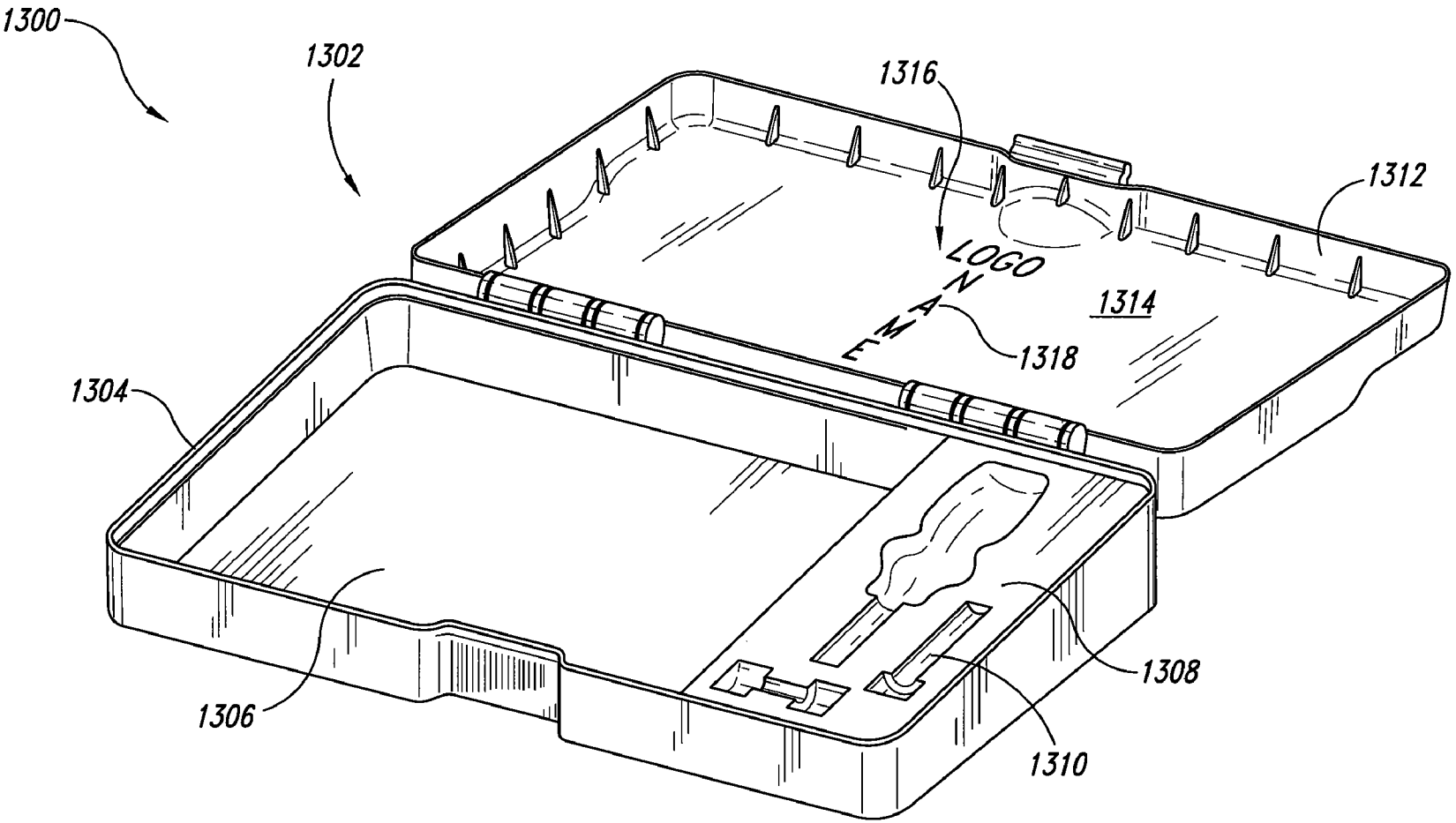
FIG. 13A is a front perspective view of another embodiment of a tool container in an open position illustrating a base portion having a cavity to insert tool recess modules in accordance with the invention.
Figure 13B:
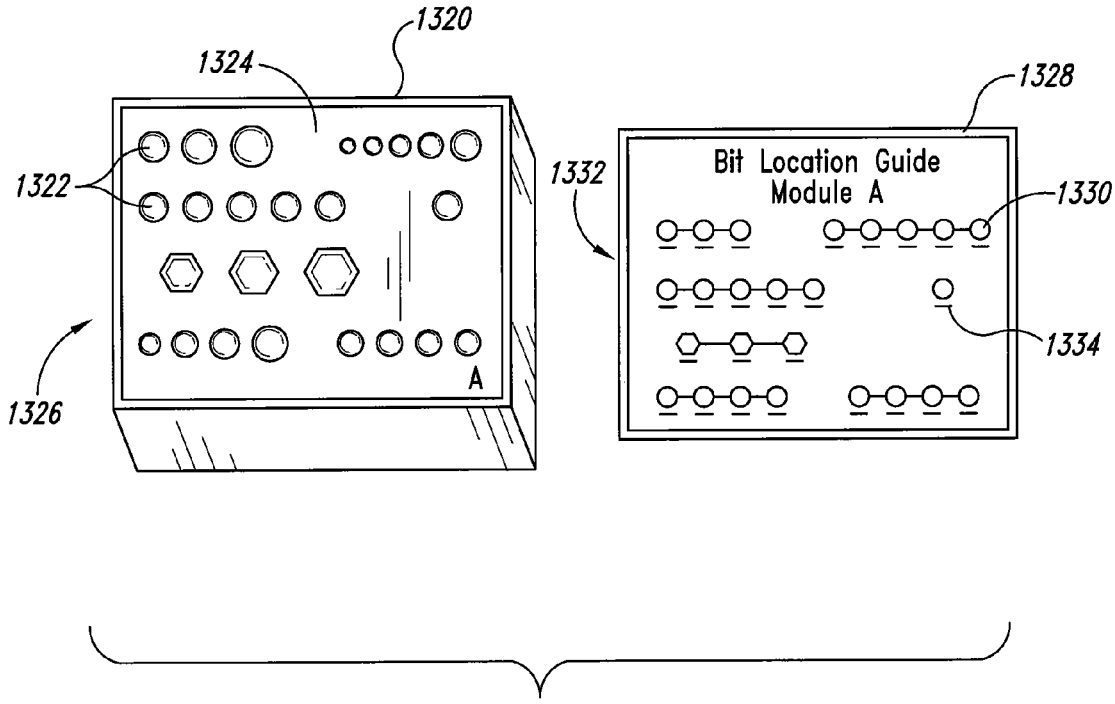
FIG. 13B is top perspective view of a tool recess module and a corresponding tool position module guide in accordance with an embodiment of the invention.
Figure 13C:
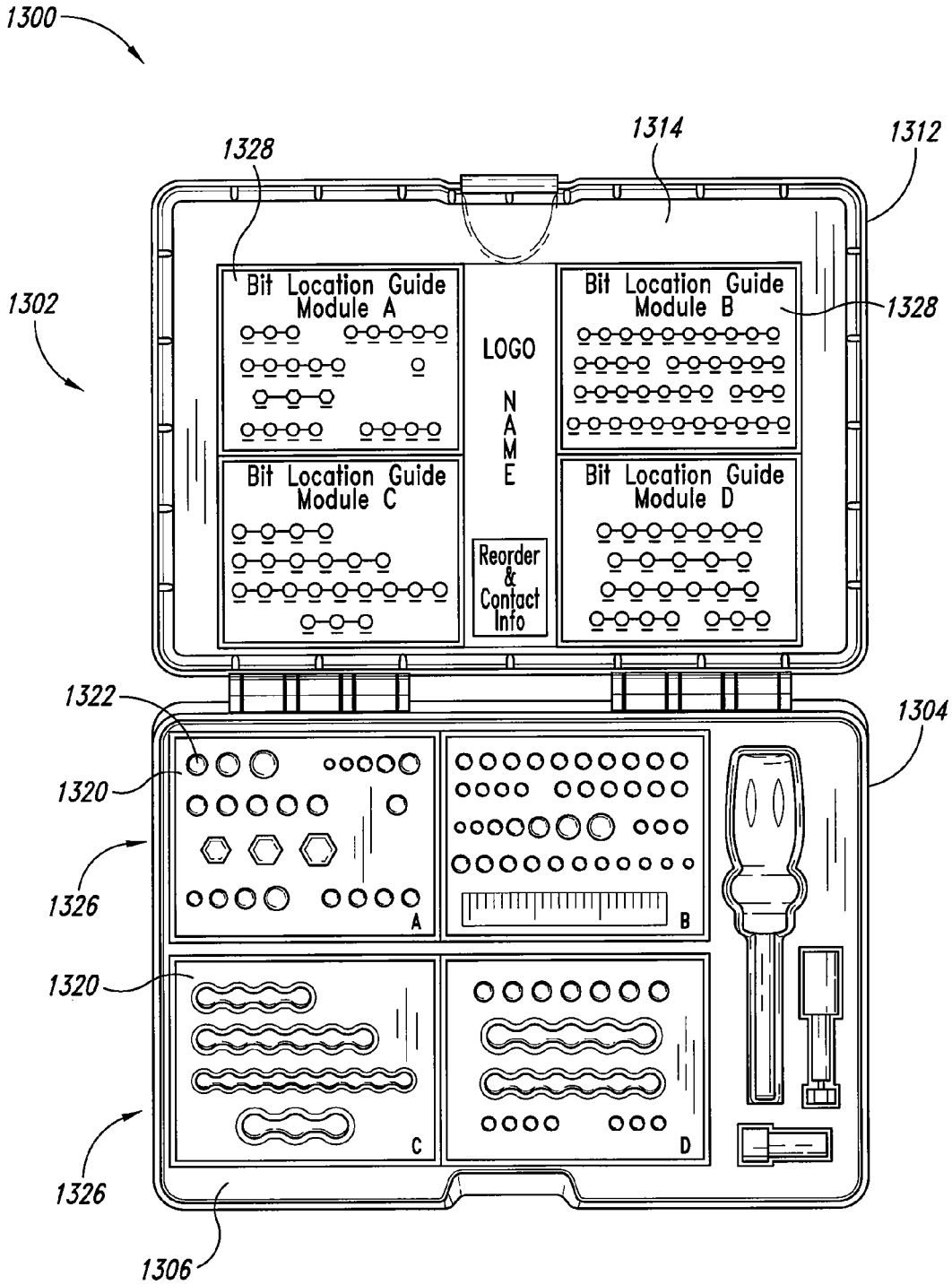
FIG. 13C is a top view of the tool container of FIG. 13A having a plurality of tool recess modules and corresponding tool position module guides in accordance with an embodiment of the invention.

C. Additional Embodiments of Containers for Carrying and Organizing Tools and Tool Sets FIGS. 13A-C illustrate another embodiment of a tool organizational system 1300 in accordance with the invention. FIG. 13A is a front perspective view of another embodiment of a tool container 1302 in an open position illustrating a base portion 1304 having a cavity 1306 to insert one or more tool recess modules (described below). The base portion 1304 can incorporate a permanent internal portion 1308 having recesses 1310 configured to retain tools, as shown in FIG. 13A. In other embodiments, however, the base portion 1304 does not have a permanent internal portion 1308. A lid portion 1312 can be configured to receive tool position module guides (described below) corresponding to the tool recess modules received in the cavity 1306. An inner surface 1314, or other surface, of the lid portion 1312 can also contain one or more regions 1316 having more generalized information 1318 such as the company name, company logo, contact information, etc.

FIG. 13B is a top perspective view of a tool recess module 1320 configured to be received and retained in the cavity 1306 of the base portion 1304 of the container 1302. The module 1320 shown in FIG. 13B has dimensions less than the base portion cavity 1306 such that more than one module 1320 can be received in the cavity 1306. In other embodiments, the module 1320 can be configured to fill the entire cavity 1306 such that only a single module 1320 can be accommodated in the cavity 1306 at any one time. The module 1320 is provided with a plurality of recesses 1322 configured to receive and retain multiple tools. The recesses 1322 are disposed in an upper surface 1324 in a module recess pattern 1326 which can be similar to the recess patterns 122, 1102 and 1202 previously described.

As shown in FIG. 13B, the module 1320 can be accompanied by a tool position module guide 1328 in accordance with an embodiment of the invention. The tool position module guide 1328 can include a plurality of images 1330 arranged in an image pattern 1332 wherein the image pattern 1332 is generally similar to the recess pattern 1326 of the corresponding module 1320. The tool position module guide 1328 can also contain tool information 1334 specific for the tools to be incorporated in the corresponding recesses 1322.

FIG. 13C is a top view of the tool container 1302 of FIG. 13A having a plurality of tool recess modules 1320 in the cavity 1306 of the base portion 1304 and corresponding tool position module guides 1328 attached to the inner surface 1314 of the lid portion 1312. In the embodiment shown, the modules 1320 A-D have different recess patterns 1326 and are configured to retain different tools and tool sets. The modules 1320 A-D are received in the cavity 1306 in the configuration shown in FIG. 13C, however, the modules 1320 A-D can be received in other configurations. The illustrated embodiment has the advantage that a user can select one or more desired modules 1320 for incorporation in the system 1300. Additionally, a user can rearrange the modules 1320 into an alternate configuration if desired, or a user can interchange one or more modules 1320 with alternate modules (not shown) having other recesses 1322, recess patterns 1326, etc. for carrying and transporting differing tools. These alternate modules can be provided with module-specific tool position module guides (not shown) that are also interchangeable with the tool position module guides 1328 specific for modules 1320 A-D. In a further embodiment, module placement holders (not shown), which do not have recesses 1322, can be positioned in the cavity 1306 of the base portion 1304 to prevent movement of modules 1320 within the cavity 1306 during transport of the tool container 1302.

From the foregoing, it will be appreciated that specific embodiments of the invention have been described herein for purposes of illustration, but that various modifications may be made without deviating from the invention. Furthermore, aspects of the invention described in the context of particular embodiments may be combined or eliminated in other embodiments. Further, while advantages associated with certain embodiments of the invention have been described in the context of those embodiments, other embodiments may also exhibit such advantages, and not all embodiments need necessarily exhibit such advantages to fall within the scope of the invention. Accordingly, the invention is not limited, except as by the appended claims.

We claim:

1. A container for carrying and organizing tools, the container comprising:

a housing having a base portion and a lid portion joined to the base portion with a hinge;

a plurality of generally circular recesses disposed in an internal portion of the container and arranged in a recess pattern, the recess pattern comprising an interconnected series of individual recesses, the recesses configured to releaseably retain the tools in the housing; and an insertable tool position guide removably coupled to a surface of the lid portion, the insertable tool position guide having a plurality of images arranged in an image pattern, wherein:

the number and shape of images in the image pattern corresponds to the number and shape of recesses in the recess pattern;

the arrangement of images in the image pattern corresponds to the arrangement of recesses in the recess pattern, with each image corresponding to a particular recess; and the position guide communicates tool identification information.

2. The container of claim 1 wherein the tool position guide is replaceable.

3. The container of claim 1 wherein the position guide is releaseably attached to an interior surface of the housing and the information on the position guide is visible when the lid portion is an open position relative to the base portion.

4. The container of claim 1 wherein the tool position guide includes a label configured to be attached to the lid portion.

5. The container of claim 1 wherein the tool position guide includes a label with a first laminated surface and a second marking surface.

6. The container of claim 1 wherein the tool position guide includes at least a first portion that is grease-resistant.

7. The container of claim 1 wherein the tool position guide is configured to have a markable surface for writing user-specific information.

8. The container of claim 1 wherein the tool identification information includes a name of a manufacture.

9. The container of claim 1 wherein the tool position guide includes at least one of a company name and a company logo.

10. The container of claim 9 wherein the tool position guide includes one of the company name and company logo printed in a color other than black or white.

11. The assembly of claim 1 wherein the tool position guide is attached to the housing with a clip.

12. The assembly of claim 1 wherein the tool position guide is attached to the housing with a magnet.

13. The container of claim 1 wherein the tool position guide is a static adhering material configured to releaseably adhere to a surface of the lid portion.

14. The container of claim 1 wherein the lid portion is pivotally attached to the base portion.

15. The container of claim 1 wherein the lid portion is configured to cover the base portion in a closed position to form an interior cavity, and wherein the internal portion is enclosed by the interior cavity.

16. The container of claim 15 wherein the lid portion includes an undulating inner surface for retaining the tools in the recesses while in the closed position.

17. The assembly of claim 1 wherein at least a portion of the housing is formed through an injection molding process or a blow molding process.

18. The assembly of claim 1 wherein the tool position guide has a back surface having an informational design, and wherein the housing includes a transparent region for showing at least the back surface of the tool position guide.

19. The container of claim 1 wherein the recesses include a plurality of holes having varying depths and diameters.

20. The container of claim 1 wherein the recesses include an elongated impression having a retaining mechanism, the impression configured to accommodate an elongated tool, and wherein the retaining mechanism prevents the elongated tool from unassisted dislocation from the elongated impression.

21. The container of claim 1 wherein the recesses are configured to receive a plurality of screwdriver bits having different sizes, and wherein the tool position guide has images corresponding to the recesses and information corresponding to the bits.

22. The container of claim 1 wherein the recesses include apertures configured to retain screwdriver bits and an impression configured to retain a screw driver.

23. The container of claim 1 wherein the recess pattern is non-symmetrical.

24. A tool storage assembly, the assembly comprising:

a housing configured to transition between an open position and a closed position, the housing having a base portion, an interior compartment in the base portion for retaining a plurality of tools, and a lid portion joined to the base portion with a hinge;

a first tool module configured to be received in the housing, the first tool module having a plurality of first generally circular recesses for releaseably retaining the tools in a first recess pattern, the first recess pattern comprising an interconnected series of individual recesses; and a first position label removably coupled to a surface of the lid portion, the first label having a plurality of first images in a first image pattern, the first image pattern corresponding to the first recess pattern with individual first images corresponding to particular first recesses, wherein the number and shape of first images in the first image pattern corresponds to the number and shape of first recesses in the first recess pattern, and wherein the first position label communicates information corresponding to tool placement in the first tool module.

25. The assembly of claim 24 wherein the first tool module is interchangeable.

26. The assembly of claim 24 wherein the base portion is configured to receive the first tool module, the lid portion is pivotally attached to the base portion and configured to move between an open position and a closed position, and wherein the first tool position label is visible in the open position.

27. The assembly of claim 26 wherein:

the base portion is configured to receive the first tool module and a second tool module having a plurality of second recesses for releaseably retaining the tools in a second recess pattern; and the lid portion is configured to receive the first tool position label corresponding to the first tool module and a second tool position label having images in a second image pattern, the second image pattern corresponding to the second recess pattern, and wherein the second tool position label communicates information corresponding to tool placement in the second tool module.

28. The assembly of claim 24 wherein at least a portion of the housing is formed through an injection molding process or a blow molding process.

29. The assembly of claim 24 wherein the first tool position label includes a grease-resistant surface.

30. The assembly of claim 24 wherein the first tool position label is configured to have a markable surface for writing user-specific information.

31. The assembly of claim 24 wherein the first tool position label has a back surface having an informational design, and wherein the housing includes a transparent region for showing at least the back surface of the first tool position label.

32. A gunsmith container comprising:

a base portion having a raised pallet configured to be housed in the container;

a lid portion coupled to the base portion along one edge region with a hinge;

a plurality of generally circular recesses formed in the pallet in a recess pattern, the recess pattern comprising an interconnected series of the individual recesses, and the recesses configured to releaseably engage tools and tool accessories; and an insertable tool position guide removably attached to a surface of the lid portion and having a plurality of images in an image pattern, wherein:

the image pattern corresponds to the recess pattern, with each image corresponding to and shaped like a particular recess; and the tool position guide includes positional information relating to the tools and tool accessories.

33. The container of claim 32 wherein the recesses include apertures of varying depths.

34. The container of claim 32 wherein the recesses include an elongated impression configured to accommodate an elongated tool.

35. The container of claim 32 wherein the recesses are configured to receive a plurality of screwdriver bits having different sizes, and wherein the tool position guide has images corresponding to the recesses and information corresponding to the bits.

36. A gunsmith container for carrying and organizing tools, the container comprising:

a housing having a base portion and a lid portion joined to the base portion with a hinge;

a plurality of generally circular recesses disposed in an internal portion of the base portion and arranged in an interconnected recess pattern, the recesses configured to releaseably retain the tools in the housing; and an insertable tool position guide removably attached to the lid portion and having a plurality of images arranged in an image pattern, wherein:

the number and arrangement of images in the image pattern corresponds to the number and arrangement of recesses in the recess pattern, with individual images corresponding to and shaped like particular recesses; and the position guide communicates positional information relating to the tools.

37. A gunsmith container, comprising:

a housing having a base portion and a lid portion joined to the base portion with a hinge;

a plurality of recesses disposed in an internal portion of the base portion and arranged in a recess pattern, the recesses configured to releaseably retain the tools in the housing;

a plurality of gunsmithing bits, wherein individual bits are positioned in individual recesses; and an insertable tool position guide removably attached to the lid portion and having a plurality of images arranged in an image pattern, wherein:

the number and arrangement of images in the image pattern corresponds to the number and arrangement of recesses in the recess pattern, with individual images corresponding to particular recesses; and the position guide communicates positional information relating to the tools.

38. The gunsmith container of claim 37 wherein the bits and the recesses each have generally circular cross-sectional shapes, and wherein individual images have generally circular shapes generally the same size as the corresponding recess.

* * * * *